US010851598B2

(12) United States Patent
DeCosta, Jr.

(10) Patent No.: US 10,851,598 B2
(45) Date of Patent: Dec. 1, 2020

(54) COMMUNICATIVE COUPLER FOR A WELL SYSTEM

(71) Applicant: Intelliserv, LLC, Houston, TX (US)

(72) Inventor: Robert John DeCosta, Jr., Spanish Fork, UT (US)

(73) Assignee: Intelliserv, LLC, Houston, TX (US)

( * ) Notice: Subject to any disclaimer, the term of this patent is extended or adjusted under 35 U.S.C. 154(b) by 215 days.

(21) Appl. No.: 15/765,393

(22) PCT Filed: Oct. 1, 2015

(86) PCT No.: PCT/US2015/053422
§ 371 (c)(1),
(2) Date: Apr. 2, 2018

(87) PCT Pub. No.: WO2017/058230
PCT Pub. Date: Apr. 6, 2017

(65) Prior Publication Data

US 2018/0283108 A1 Oct. 4, 2018

(51) Int. Cl.

| | |
|---|---|
| ***E21B 17/02*** | (2006.01) |
| ***E21B 19/087*** | (2006.01) |
| ***E21B 47/13*** | (2012.01) |
| ***E21B 47/092*** | (2012.01) |
| ***E21B 19/16*** | (2006.01) |

(52) U.S. Cl.
CPC ..... *E21B 17/028* (2013.01); *E21B 17/02* (2013.01); *E21B 19/087* (2013.01); *E21B 19/16* (2013.01); *E21B 47/092* (2020.05); *E21B 47/13* (2020.05)

(58) Field of Classification Search
CPC ..... E21B 17/028; E21B 47/13; E21B 19/16
See application file for complete search history.

(56) References Cited

U.S. PATENT DOCUMENTS

| | | | |
|---|---|---|---|
| 5,455,573 | A | 10/1995 | Delatorre |
| 5,980,290 | A | 11/1999 | Meynier et al. |
| 2003/0075317 | A1 | 4/2003 | George |
| 2005/0284662 | A1 | 12/2005 | Hall et al. |
| 2006/0260797 | A1 | 11/2006 | Hall et al. |
| 2013/0186641 | A1 | 7/2013 | Lovell |

OTHER PUBLICATIONS

International Search Report and Written Opinion dated Jun. 27, 2016 for Application No. PCT/US2015/053422 (9 pgs).
Extended European Search Report dated Aug. 28, 2019, for Application No. 15905610.0.

*Primary Examiner* — Kristyn A Hall
(74) *Attorney, Agent, or Firm* — Conley Rose, P.C.

(57) ABSTRACT

A communicative coupler for a tubular member including a hub having a longitudinal hub axis and a chamber disposed therein, a coil disposed in the hub for electromagnetically communicating with a coil of the tubular member, a shaft having a longitudinal shaft axis, a first end, and a second end, wherein the second end of the shaft is pivotally coupled to the hub, and a positioning assembly disposed in the chamber of the hub that engages the second end of the shaft, and wherein the positioning assembly is configured to allow the longitudinal shaft axis to become laterally offset from the longitudinal hub axis.

24 Claims, 15 Drawing Sheets

COMMUNICATIVE COUPLER FOR A WELL SYSTEM

CROSS-REFERENCE TO RELATED APPLICATIONS

This application is a 35 U.S.C. § 371 national stage application of PCT/US2015/053422 filed Oct. 1, 2015, and entitled "Communicative Coupler for a Well System" which is incorporated herein by reference in its entirety for all purposes.

STATEMENT REGARDING FEDERALLY SPONSORED RESEARCH OR DEVELOPMENT

Not applicable.

BACKGROUND

The disclosure relates generally to well systems. More particularly, the disclosure relates to systems electromagnetically communicating with tubular members of well systems using communicative couplers. Still more particularly, the disclosure relates to couplers permitting electromagnetic communication with tubular members as they are moved in and out of alignment with the wellbore and while suspended from drilling apparatus.

In the oil and gas production industry, during the processes of "tripping" in and out of a wellbore as part of an effort to recover oil and gas, several operations may need to be performed on drill pipe that is either being coupled with or removed from a drill string. For instance, threads that form the housing and box end of particular drill pipe tubulars may need to be lubricated prior to being made up or coupled to an adjacent tubular. Also, in the case of wired drill pipe (WDP), testing may be performed on the electromagnetic couplers disposed at each end of the wired drill pipe to ensure the reliability of a downhole communications network that is enabled by the functionality provided by the electromagnetic couplers. Performing these operations increases the amount of nonproductive time spent during the overall drilling operation by lengthening the time spent making up or breaking out drill pipe tubulars as they are placed in or removed from the wellbore. In some instances, movement by either the WDP itself or the elevator transporting the WDP may result in relative movement between the WDP and a communicative coupler that is supported by the elevator and employed in transmitting signals between the WDP and a diagnostic interface of the well system. Such relative movement may jeopardize the integrity of the coupling between the communicative coupler and the WDP that typically has been necessary to maintain an electromagnetic connection between the WDP and communicative coupler and to perform the desired diagnostic procedure.

SUMMARY OF THE DISCLOSURE

An embodiment of a communicative coupler for a tubular member comprises a hub having a longitudinal hub axis and a chamber disposed therein, a coil disposed in the hub for electromagnetically communicating with a coil of the tubular member, a shaft having a longitudinal shaft axis, a first end, and a second end, wherein the second end of the shaft is pivotally coupled to the hub, and a positioning assembly disposed in the chamber of the hub that engages the second end of the shaft, and wherein the positioning assembly is configured to allow the longitudinal shaft axis to become laterally offset from the longitudinal hub axis. In an embodiment, the communicative coupler further comprises a first electrical connector coupled to the first end of the shaft, and a connector assembly, comprising a mechanical connector configured to releasably couple with the first end of the shaft, and a second electrical connector configured to releasably connect with the first electrical connector, wherein the connector assembly is configured to connect the first electrical connector with the second electrical connector irrespective of the angular orientation between the mechanical connector and the shaft. In an embodiment, the mechanical connector of the connector assembly comprises an elongate member having a radially translatable member disposed in a radial aperture of the elongate member, and a sleeve disposed about the elongate member that is slideable respective the elongate member and is configured to engage the radially translatable member. In an embodiment, the mechanical connector comprises a connected position wherein the sleeve is configured to forcibly dispose the radially translatable member in a groove that is disposed in the shaft to restrict relative movement between the elongate member and the sleeve, and a disconnected position wherein the radially translatable member is disposed in a groove of the sleeve and is configured to permit relative movement between the sleeve and the elongate member. In an embodiment, the positioning assembly comprises a first positioning member having a receptacle for receiving the second end of the shaft, and a second positioning member in engagement with the first positioning member, wherein the second positioning member comprises a first tongue that is received within a groove of an internal surface of the hub to provide for sliding engagement between the second positioning member and the hub along a first lateral direction respective the longitudinal hub axis. In an embodiment, the second positioning member comprises a second tongue that is received within a groove of the first positioning member for providing sliding engagement between the second positioning member and the first positioning member along a second lateral direction respective the longitudinal hub axis. In an embodiment, the first lateral direction is disposed substantially orthogonal the second lateral direction. In an embodiment, the communicative coupler further comprises a ball disposed in both a groove in the second end of the shaft and a receptacle of the positioning assembly to restrict relative rotation between the shaft and the positioning assembly about the longitudinal shaft axis.

An embodiment of a communicative coupler for a tubular member comprises a hub having a chamber disposed therein and an internal surface, a coil disposed in the hub for electromagnetically communicating with a coil of the tubular member, a shaft having a first end and a second end, wherein the second end of the shaft is pivotally coupled to the hub, and a positioning assembly disposed in the chamber, wherein the positioning assembly is configured to slidingly engage the second end of the shaft and the internal surface of the hub. In an embodiment, the communicative coupler further comprises a first electrical connector coupled to the first end of the shaft, and a connector assembly, comprising a mechanical connector configured to releasably couple with the first end of the shaft, and a second electrical connector configured to releasably connect with the first electrical connector, wherein the connector assembly is configured to connect the first electrical connector with the second electrical connector irrespective of the angular orientation between the mechanical connector and the shaft. In an embodiment, the connector mechanical connector of the connector assembly comprises an elongate member having a radially translatable member disposed in a radial aperture of the elongate member, and a sleeve disposed about the elongate member that is slideable respective the elongate member and is configured to engage the radially translatable member. In an embodiment, the mechanical connector comprises a connected position wherein the sleeve is configured to forcibly dispose the radially translatable member in a groove disposed in the shaft to restrict relative movement between the elongate member and the sleeve, and a disconnected position wherein the radially translatable member is disposed in a groove of the sleeve and is configured to permit relative movement between the sleeve and the elongate member. In an embodiment, the second end of the shaft comprises a ball received within the positioning assembly to form a ball joint between the shaft and the hub. In an embodiment, the positioning assembly comprises a first positioning member having a receptacle for receiving the second end of the shaft, and a second positioning member in engagement with the first positioning member, wherein the second positioning member comprises a first tongue that is received within a groove of an internal surface of the hub to provide for sliding engagement between the second positioning member and the hub along a first lateral direction respective the longitudinal hub axis. In an embodiment, the second positioning member comprises a second tongue that is received within a groove of the first positioning member for providing sliding engagement between the second positioning member and the first positioning member along a second lateral direction respective the longitudinal hub axis. In an embodiment, the first lateral direction is disposed substantially orthogonal the second lateral direction.

An embodiment of a well system comprises an elevator coupled to a drilling rig, wherein the elevator is configured to support a tubular member, and a communicative coupler coupled to the tubular member, comprising a hub having a longitudinal hub axis and a chamber disposed therein, a coil disposed in the hub for electromagnetically communicating with a coil of the tubular member, and a shaft having a longitudinal shaft axis, a first end, and a second end, wherein the second end of the shaft comprises a ball and is pivotally coupled to the hub, wherein the ball of the shaft is permitted to displace laterally respective the longitudinal hub axis of the hub within the chamber of the hub. In an embodiment, wherein the communicative coupler of the well system further comprises a first electrical connector coupled to the first end of the shaft, and a connector assembly, comprising a mechanical connector configured to releasably couple with the first end of the shaft, and a second electrical connector configured to releasably connect with the first electrical connector, wherein the connector assembly is configured to connect the first electrical connector with the second electrical connector irrespective of the angular orientation between the mechanical connector and the shaft. In an embodiment, the connector mechanical connector of the connector assembly comprises an elongate member having a radially translatable member disposed in a radial aperture of the elongate member, and a sleeve disposed about the elongate member that is slideable respective the elongate member and is configured to engage the radially translatable member. In an embodiment, the mechanical connector comprises a connected position wherein the sleeve is configured to forcibly dispose the radially translatable member in a groove disposed in the shaft to restrict relative movement between the elongate member and the sleeve, and a disconnected position wherein the radially translatable member is disposed in a groove of the sleeve and is configured to permit relative movement between the sleeve and the elongate member. In an embodiment, the mechanical connector is in the connected position, an electrical connection is formed between the coil of the hub and a surface interface system. In an embodiment, the positioning assembly comprises a first positioning member having a receptacle for receiving the ball of the shaft, and a second positioning member engaging the first positioning member, wherein the second positioning member comprises a first tongue that is received within a groove of an internal surface of the hub to provide for sliding engagement between the second positioning member and the hub along a first lateral direction respective the longitudinal hub axis. In an embodiment, the second positioning member comprises a second tongue that is received within a groove of the first positioning member for providing sliding engagement between the second positioning member and the first positioning member along a second lateral direction respective the longitudinal hub axis. In an embodiment, the first lateral direction is disposed substantially orthogonal the second lateral direction.

BRIEF DESCRIPTION OF THE DRAWINGS

The present embodiments may be better understood, and numerous objects, features, and advantages made apparent to those skilled in the art by referencing the accompanying drawings. These drawings are used to illustrate only typical embodiments of this disclosure, and are not to be considered limiting of its scope. The figures are not necessarily to scale, and certain features and certain views of the figures may be shown exaggerated in scale or in schematic in the interest of clarity and conciseness.

DETAILED DESCRIPTION OF DISCLOSED EXEMPLARY EMBODIMENTS

Figure 1:
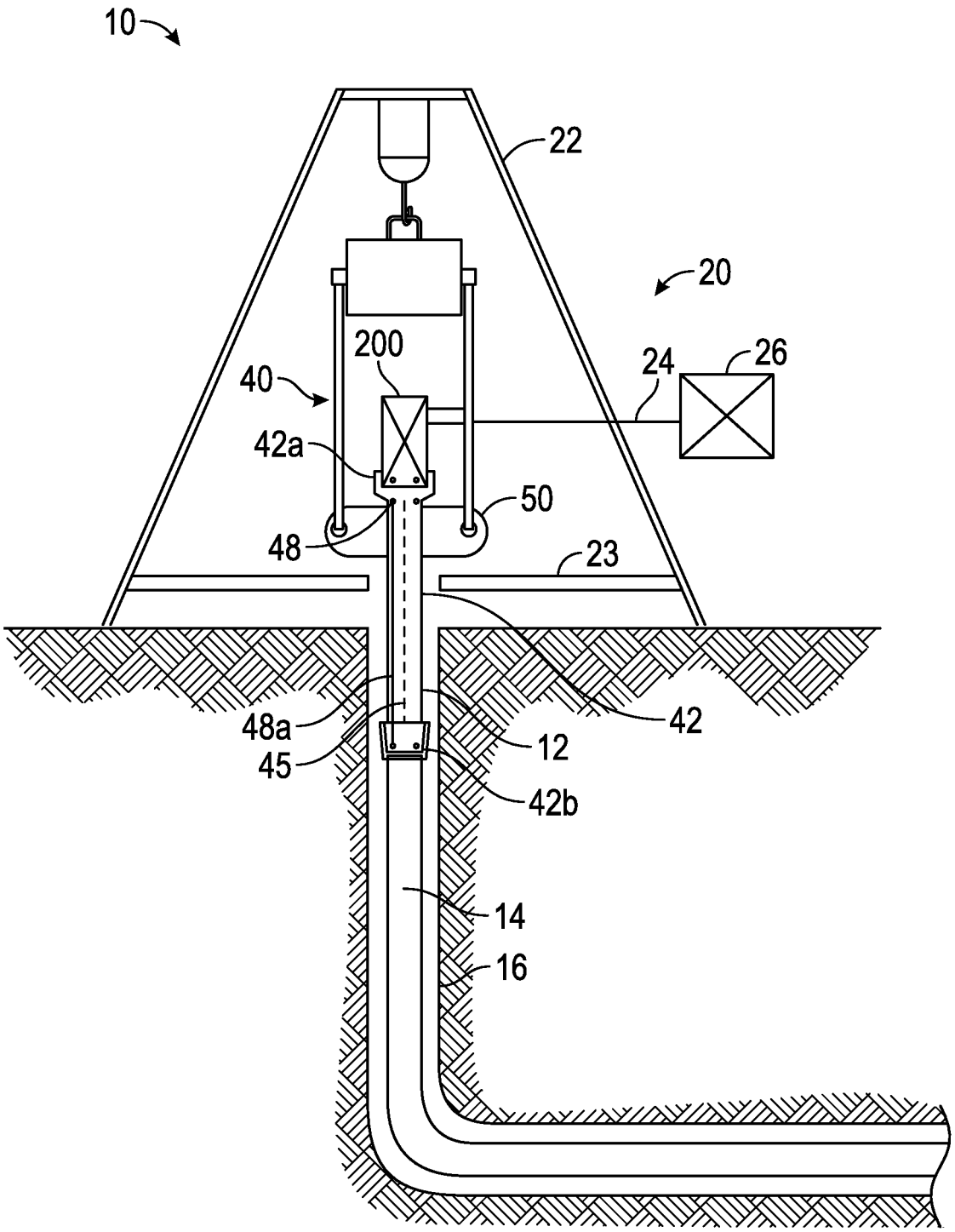
FIG. 1 is a schematic view of a well system deployed at a wellsite, the well system including a testing or diagnostic system in accordance with principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form, and some details of conventional elements may not be shown in interest of clarity and conciseness.

Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . " The phrase "internal threads" refers to the female threads cut into the end of a length of pipe. In addition, reference to the terms "left" and "right" are made for purposes of ease of description. The terms "pipe," "tubular member," "casing" and the like as used herein shall include tubing and other generally cylindrical objects. The various characteristics mentioned above, as well as other features and characteristics described in more detail below will be readily apparent to those skilled in the art upon reading the following detailed description, and by referring to the accompanying drawings.

Figure 2A:
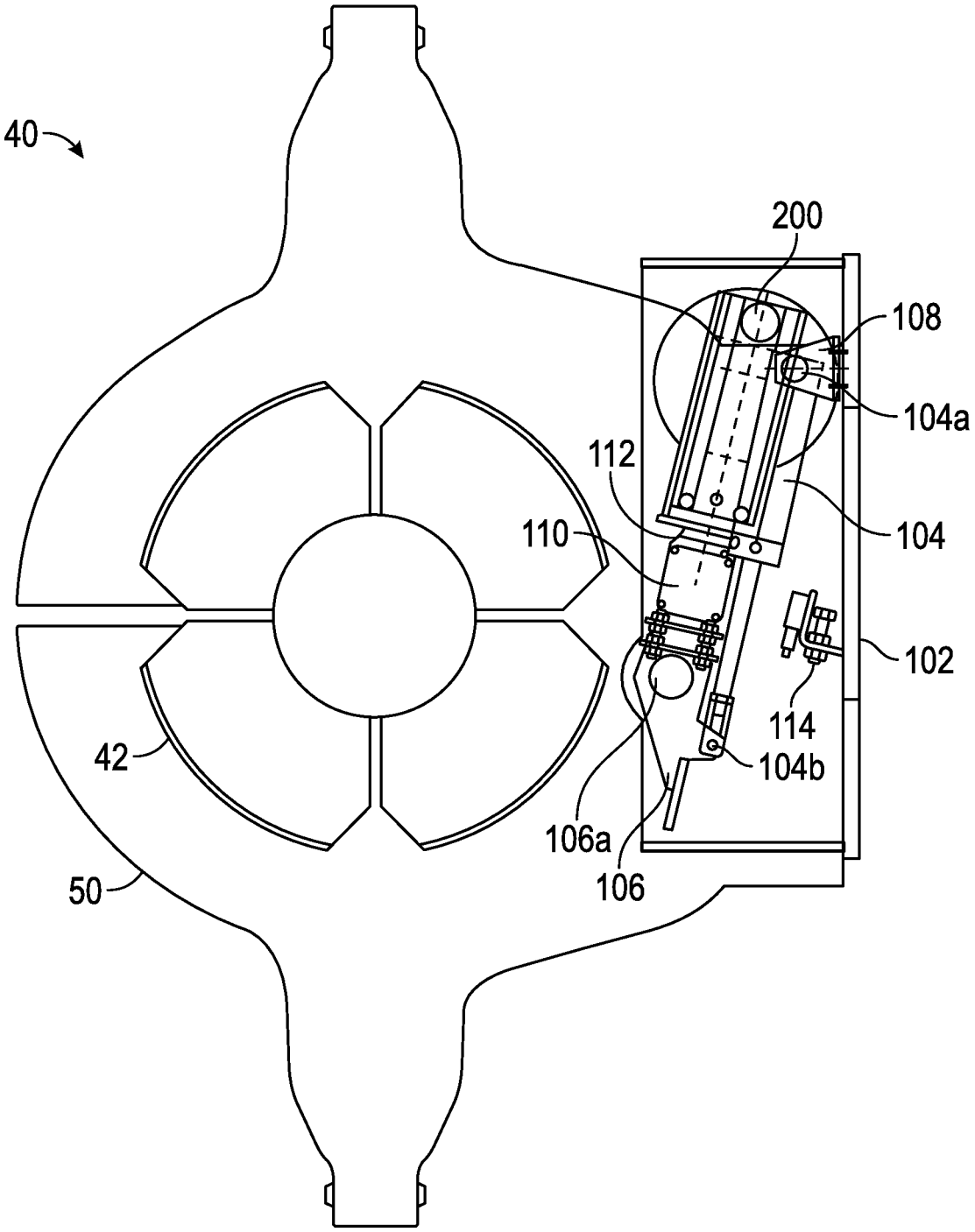
FIG. 2A is a top view of an embodiment of a system for supporting a communicative coupler in accordance with principles disclosed herein, the support system being shown in a parked position.
Figure 2C:
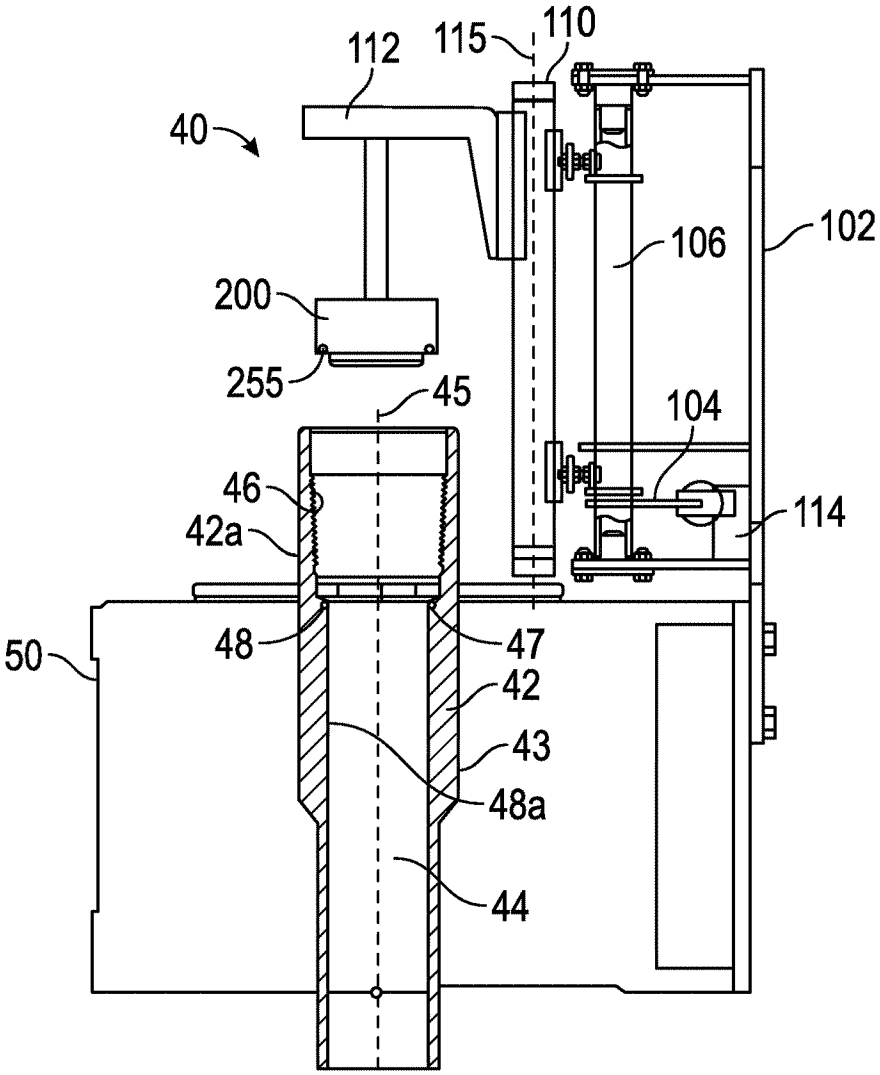
FIG. 2C is a partial sectional view of the support system of FIG. 2A shown in an extended position.
Figure 2B:
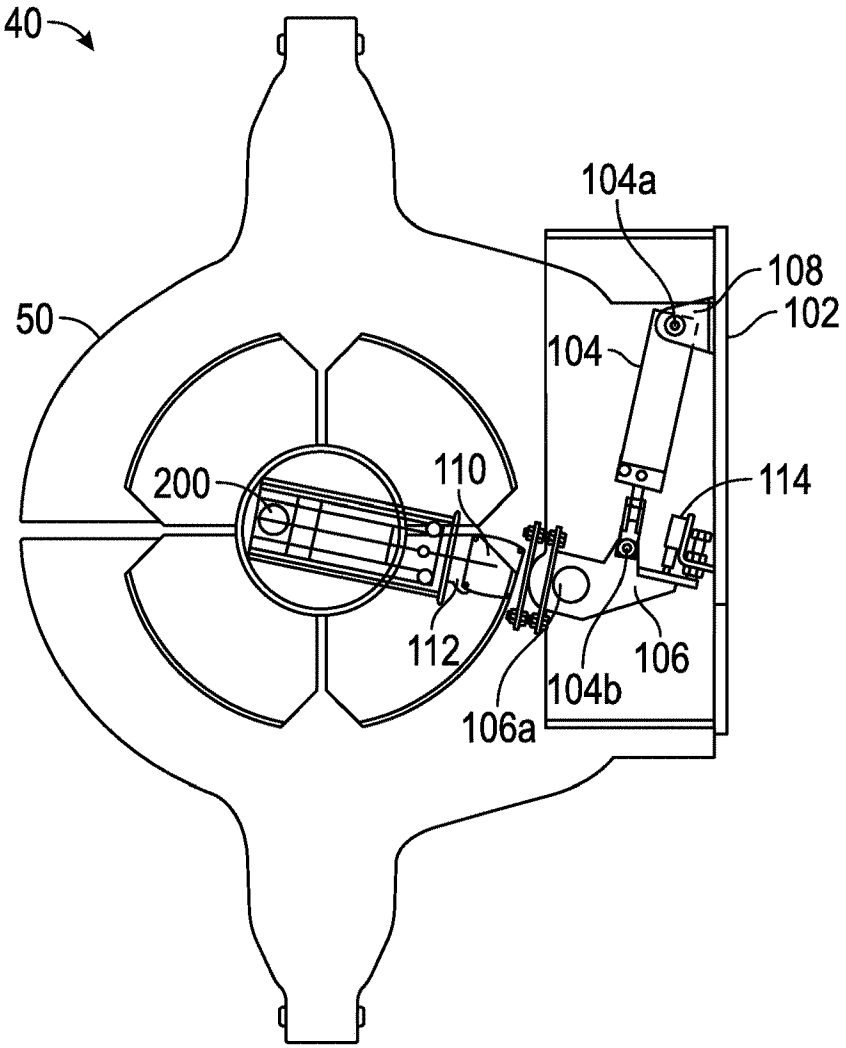
FIG. 2B is a top view of the support system of FIG. 2A shown in an extended position.

Referring to FIGS. 1 and 2C, an embodiment of a well system 10 deployed at a wellsite is shown. Well system 10 includes a downhole system generally including a plurality of tubular or wired drill pipe (WDP) 12 that forms a drill string 14 extending into an earthen formation to form a wellbore 16 therein. WDP 12 includes an uppermost tubular 42 having a central or longitudinal axis 45 (shown in FIG. 2C), and a body 43 having a central throughbore 44. The throughbore 44 includes an internally threaded section 46 proximal to an upper box end 42*a* of the uppermost tubular 42, and a lower pin end 42*b*. The throughbore 44 also includes an upper facing inner flange 47, proximal to threaded section 46. In this embodiment, flange 47 includes an annular conductor or communicative coupler 48 coupled to a cable 48*a* that extends axially through body 43 of uppermost tubular 42 (shown in FIGS. 2C and 2D) to pin end 42*b*. Well system 10 also includes a surface system 20 that generally comprises a land based derrick or drilling rig 22 having a floor 23, one or more cables 24, a surface interface system 26, a surface support system 40 and a servicing system or communicative coupler 200.

As best shown in FIG. 1, surface interface system 26 is configured to interface with communicative coupler 200 via cable 24 and may include one or more computers for receiving, processing, analyzing, sending or otherwise handling signals from communicative coupler 200. Further, surface interface system 26 may also provide support system 40 with power and control, whether that power and/or control is pneumatic, hydraulic, electric, etc., in nature. Support system 40 generally includes an elevator 50 that supports both the box end 42*a* of the uppermost tubular 42 of string 14, and the communicative coupler 200. Support system 40 is configured to support, position, and manipulate communicative coupler 200. Communicative coupler 200 is configured to interface or connect with the communicative coupler 48 of uppermost tubular 42 so as to transmit signals between surface interface system 26 and components of drill string 14. For instance, support system 40 is configured to displace communicative coupler 200 between a parked position and an extended position, where communicative coupler 200 is shown in the extended position in FIG. 1. In the extended position, communicative coupler 200 is allowed to engage uppermost tubular 42.

In this embodiment, elevator 50 of support system 40 is a hinged mechanism configured to displace pipe tubulars, including WDP tubular joints (e.g., uppermost tubular 42), into and out of a wellbore of a well system (e.g., well system 10) during the process of tripping in or out of the wellbore (e.g., wellbore 16). While well system 10 includes land based derrick 22, it will be appreciated that the well system 10 may be land or water based. Also, a portion of the surface interface system 26 may be offsite or remote from the well system 10 and/or in communication with offsite systems. Further, while well system 10 includes WDP 12, it will be appreciated that in other embodiments, well system 10 may incorporate drill pipe that is not wired drill pipe.

Referring to FIGS. 2A-2D, support system 40 generally includes elevator 50, a protective housing or support member 102, an actuator 104, and an elongate member 106 pivotally coupled to support member 102. Support system 40 further includes bracket 108 affixed to support member 102, a support post 110 coupled to elongate member 106, and a support arm 112 coupled between communicative coupler 200 and support post 110. In this embodiment, elevator 50 is coupled with and supports support member 102 while uppermost tubular 42 is suspended by the elevator 50. Extending from and coupled to elevator 50 is support member 102, which is configured to provide support to the elongate member 106, bracket 108, support post 110, and communicative coupler 200 via transferring loads applied to support member 102 to the elevator 50. Also, support member 102 is configured to protect communicative coupler 200 by shielding components of communicative coupler 200 when in the parked position shown in FIG. 2A. Although support member 102 is shown coupled to elevator 50 in FIGS. 2A-2D, support member 102 may be positioned adjacent a slip of the well system 10 in other embodiments.

In the embodiment of FIGS. 2A-2D, actuator 104 of support system 40 has a first end 104*b* coupled to bracket 108 and a second end 104*b* coupled to elongate member 106. In this embodiment, actuator 104 is configured to rotate elongate member 106 about a pivot point 106*a*, where actuator 104 may be powered via hydraulic, pneumatic, electric, or other means. In an embodiment, the power required by actuator 104 may be supplied by surface interface system 26 via cables 24, where cables 24 may comprise shielded electrical cables, hydraulic cables, and/or pneumatic cables. The rotation of elongate member 106 via actuator 104 moves support system 40 between a parked position shown in FIG. 2A and an extended position shown in FIGS. 2B-2D. Also, the member 106 may be positioned in the extended position via a positioning member or stop 114 affixed to support member 102.

Figure 2D:
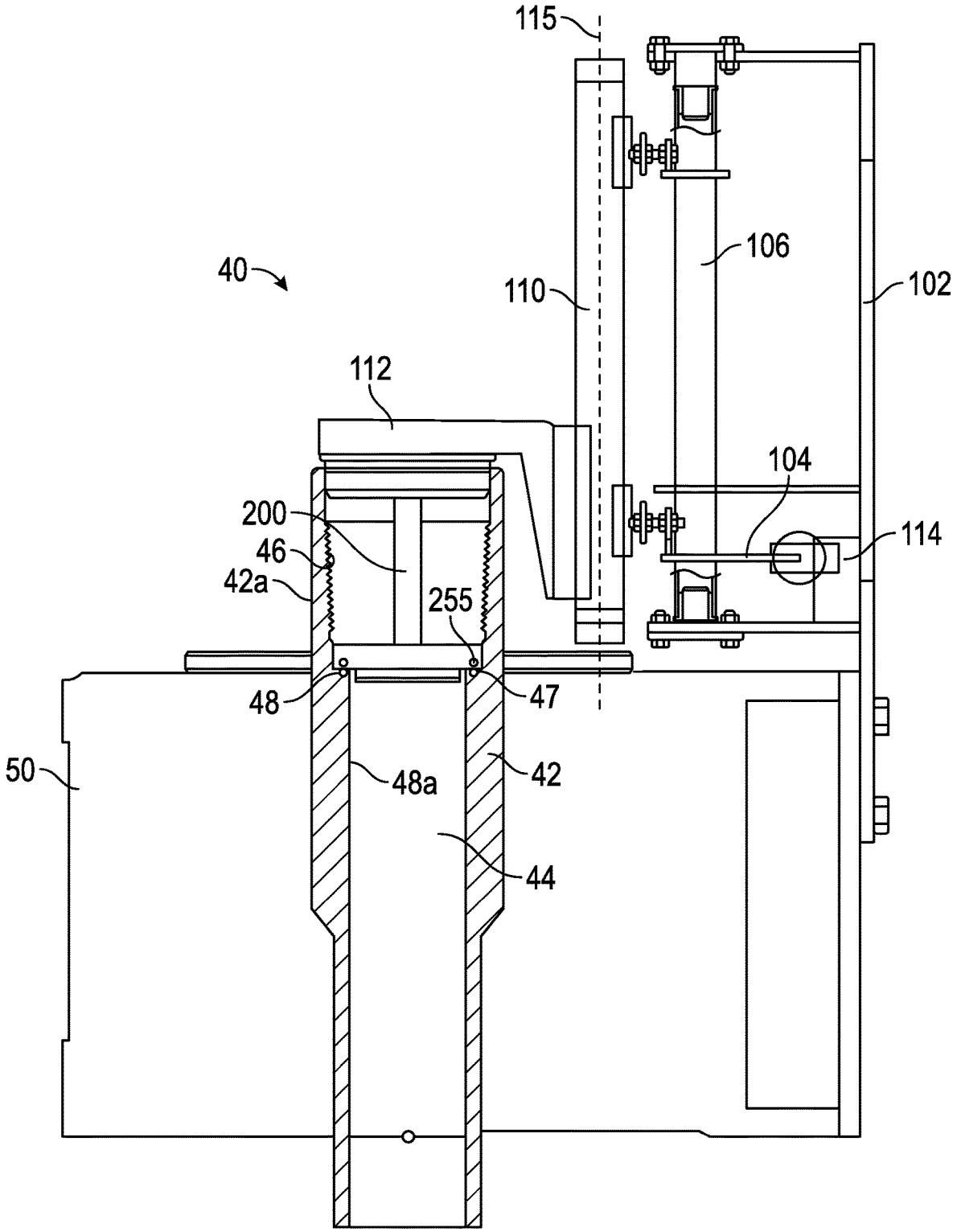
FIG. 2D is a partial sectional view of the support system of FIG. 2A shown in a coupled position.

As shown particularly in FIGS. 2C and 2D, once in the extended position, communicative coupler 200 may be displaced into an engaged position (shown in FIG. 2D) relative uppermost tubular 42 such that a communication link is formed between a coil 255 of the communicative coupler 200 and the coil 48 of uppermost tubular 42, the link being employed to pass signals, data, and/or power between components of drill string 14 and the surface interface system 26 via cables 24. In this embodiment, coil 255 comprises an electrically conductive coil disposed about an annular magnetic member for forming an electromagnetic connection with coil 48 of uppermost tubular 42. Support post 110 has a longitudinal axis 115 along which support arm 112 traverses to position communicative coupler 200 in the engaged position shown in FIG. 2D. In this embodiment, support arm 112 comprises an actuator for displacing support arm 112 longitudinally along longitudinal axis 115 of support post 110. The power required (e.g., electrical, hydraulic, or pneumatic) by the actuator of support arm 112 may be supplied by surface interface system 26 via cables 24. Although in the embodiment shown in FIGS. 1-2D communicative coupler 200 is described as forming a part of support system 40, in other embodiments, communicative coupler 200 may be used in other support systems to interface with a coil 48 of uppermost tubular 42. For instance, in other embodiments, communicative coupler 200 may be coupled to a support system disposed on rig floor 23 of rig 22. Moreover, in other embodiments communicative coupler 200 may be used with systems remote from well system 10, such as a machine shop for testing and/or manipulating WDP 12.

Figure 3:
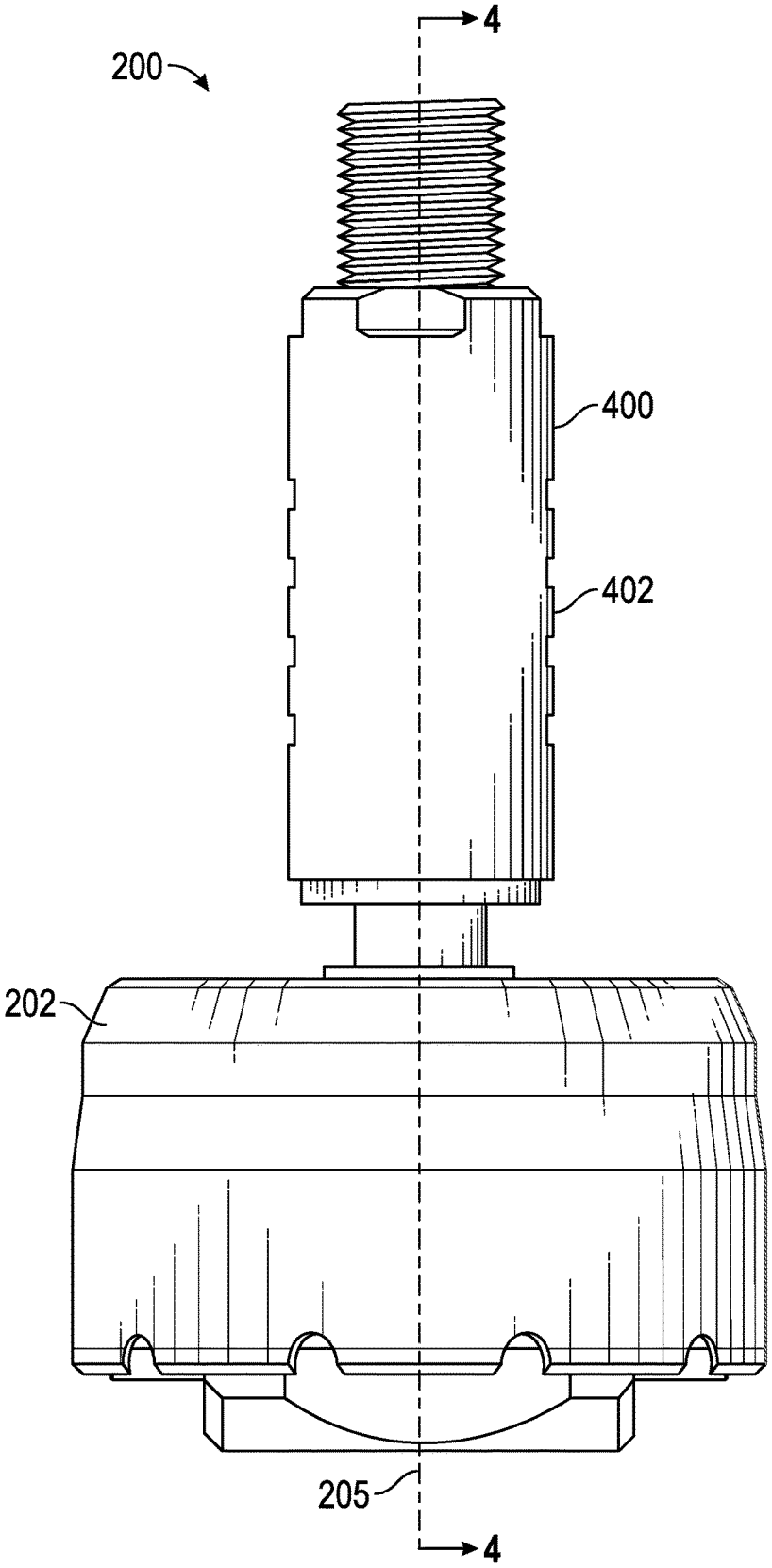
FIG. 3 is a front view of an embodiment of the communicative coupler of FIG. 2A.
Figure 4:
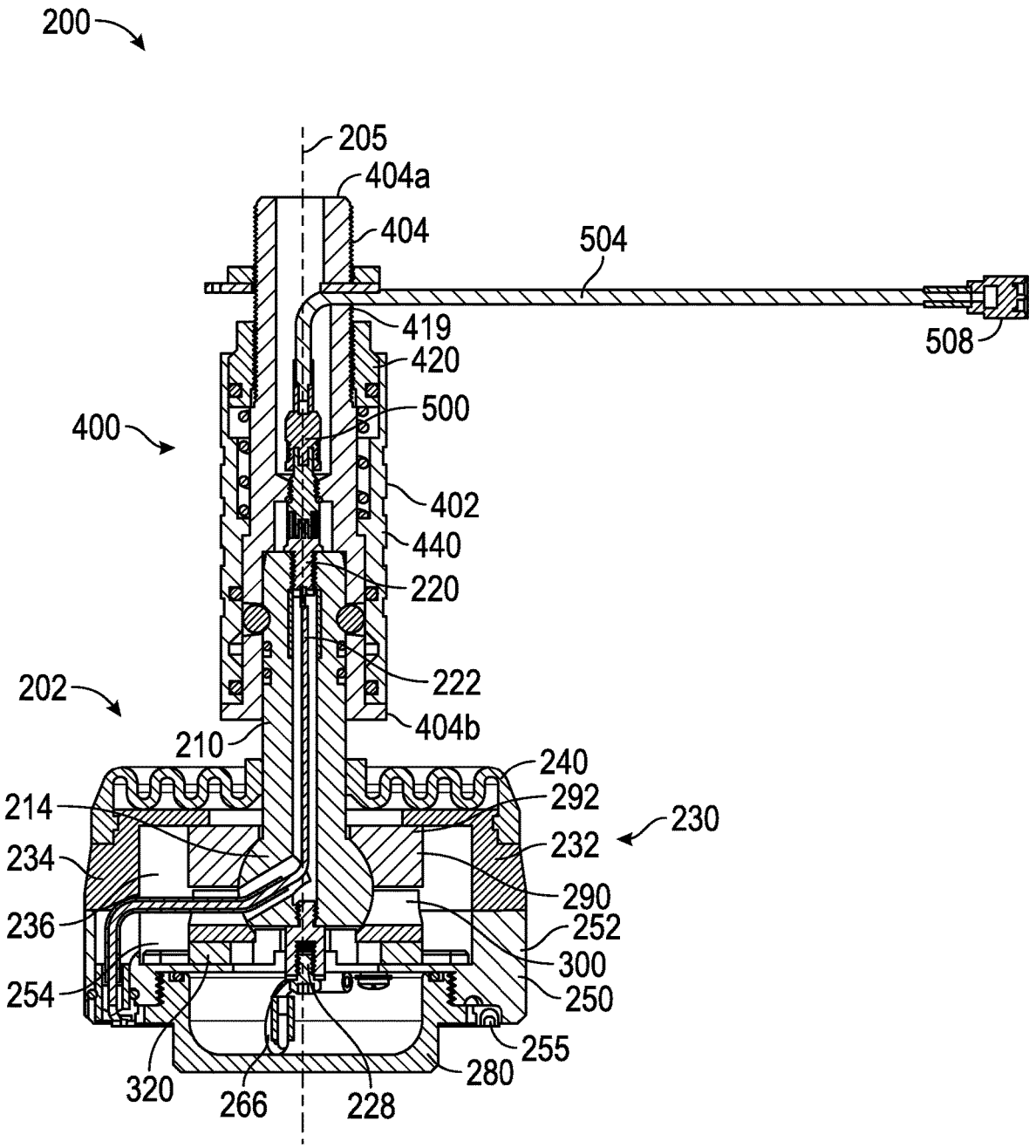
FIG. 4 is a cross-sectional view of the communicative coupler shown in FIG. 3, the section taken along lines 4-4 of FIG. 3.

Referring to FIGS. 3 and 4, communicative coupler 200 has a central or longitudinal axis 205 and generally includes a coil assembly 202 and a connector assembly 400. Coil assembly 202 is generally configured to establish a connection (e.g., an electromagnetic connection) between a coil 255 of coil assembly 202 and the coil 48 of uppermost tubular 48, and connector assembly 400 is configured to provide a releasable connection between coil assembly 202 and the support arm 112 of support system 40. Further, coil assembly 202 is configured to establish and maintain a connection between coil 255 and coil 48 when longitudinal axis 45 of uppermost tubular 42 and longitudinal axis 205 of communicative coupler 200 are both angularly and laterally offset or misaligned. More particularly, coil assembly 202 is configured to establish and maintain a connection between coil 255 and coil 48 when longitudinal axis 45 of uppermost tubular 42 and longitudinal axis 205 of communicative coupler 200 are laterally offset in both a first lateral direction and a second lateral direction, as will be explained further herein. The ability to establish and maintain a connection between coil 255 and coil 48 when longitudinal axis 45 of uppermost tubular 42 and longitudinal axis 205 of communicative coupler 200 are both angularly and laterally misaligned may be beneficial where the uppermost tubular 42 is suspended from elevator 50, given that uppermost tubular 42 may sway or move within elevator 50, causing the longitudinal axis 45 of uppermost tubular 42 to be displaced both angularly and laterally.

In the embodiment shown in FIGS. 3 and 4, connector assembly 400 comprises both a mechanical connector 402 and an electrical connector 500 (shown in FIG. 4). Mechanical connector 402 provides a mechanical connection and physical support between coil assembly 202 and support arm 112 of support system 40. Electrical connector 500 provides an electrical connection between coil 255 of coil assembly 202 and the surface interface system 26 of well system 10. Mechanical connector 402 is configured to provide a quick-change connection that allows personnel of well system 10 to disconnect and connect coil assembly 202 from connector assembly 400 and support arm 112 of support system 40 by hand without the assistance of tools. Further, connector assembly 400 is configured to allow personnel of well system 10 to connect and disconnect coil assembly 202 from support arm 112 without needing to angularly orient or "clock" an electrical connector 220 (shown in FIG. 4) of coil assembly 202 with the electrical connector 500 of connector assembly 400. In other words, the electrical connector 220 of coil assembly 202 may form an electrical connection with the electrical connector 500 of connector assembly 400 irrespective of the relative angular orientation between coil assembly 202 and connector assembly 400. The ability to connect and disconnect coil assembly 202 from connector assembly 400 and support arm 112 irrespective of the relative angular orientation between coil assembly 202 and connector assembly 400 reduces the time necessary to connect and disconnect coil assembly 202 from connector assembly 400 while also mitigating the possibility of damaging electrical connector 220 of coil assembly 202 and/or the electrical connector 500 of connector assembly 400 during connection and/or disconnection.

Figure 5:
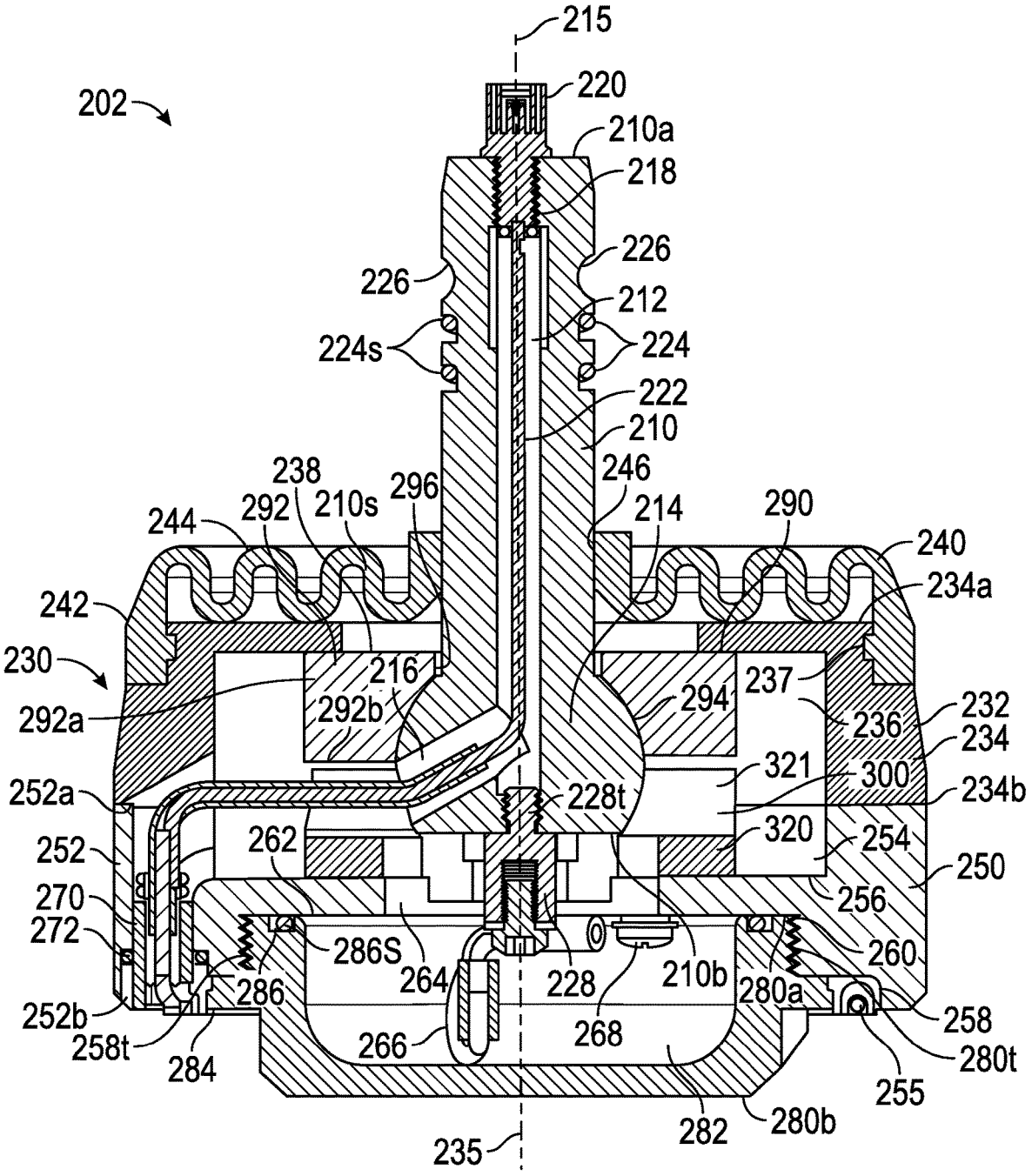
FIG. 5 is a cross-sectional view of an embodiment of a coil assembly of the communicative coupler shown in FIG. 3, the section being taken along lines 4-4 of FIG. 3.

Referring to FIG. 5, coil assembly 202 generally includes an elongate shaft 210 and a hub assembly 230. Hub assembly 230 generally includes an upper coil plate assembly 232, a lower coil plate assembly 250, and a laterally moveable ball joint assembly 290. Ball joint assembly 290 generally includes an upper ball joint receptacle 292, a lower ball joint receptacle or upper positioning member 300, and a lower positioning member 320. In this embodiment, upper positioning member 300 and lower positioning member 320 form a positioning assembly 321. Shaft 210 has a central or longitudinal axis 215, a first or upper end 210*a*, a second or lower end 210*b*, and a throughbore or passage 212 extending between upper end 210*a* and lower end 210*b*. Shaft 210 includes a generally hemispherical ball or ball joint 214 disposed at lower end 210*b* that is received and physically engaged by upper ball joint receptacle 290 and upper positioning member 300, thereby pivotally coupling shaft 210 to hub assembly 230. Shaft 210 also includes an angular bore 216 that extends from an outer surface 210*s* of shaft 210 to ball 214 at an angle relative longitudinal axis 215, the bore 216 intersecting passage 212 proximal lower end 210*b*. Passage 212 includes an internal threaded connector 218 at upper end 210*a* for threadably connecting with electrical connector 220.

As described above, electrical connector 220 is configured to form an electrical connection with electrical connector 500 of connector assembly 400 irrespective of the relative angular orientation between coil assembly 202 and connector assembly 400. A shielded electrical cable 222 connects to electrical connector 220 and extends through passage 212 and angular bore 216 of shaft 210, eventually connecting to coil 255 to form an electrical connection between coil 255 and electrical connector 220. Shaft 210 also includes a pair of longitudinally spaced annular grooves 224 extending radially into outer surface 210*s*, where each annular groove 224 receives an annular seal 224*s* disposed therein for sealing against a surface of mechanical connector 402. Shaft 210 further includes another annular groove 226 extending into outer surface 210*s*. As will be explained further herein, annular groove 226 is configured to receive corresponding balls or radially translatable members of mechanical connector 402 for forming a mechanical connection between shaft 210 and mechanical connector 402. A ground connector 228 threadably couples to an internal threaded coupler 228*t* of the passage 212 of shaft 210 at lower end 210*b*. As will be discussed further herein, ground connector 228 establishes a ground electrical connection between shaft 210 and the lower coil plate assembly 250 to ground coil assembly 202.

Hub assembly 230 of coil assembly 202 pivotally couples to ball 214 of shaft 210 and is configured to establish a connection with coil 48 of uppermost tubular 42 via coil 255 that is disposed in lower coil plate assembly 250. Hub assembly 230 has a central or longitudinal axis 235 that, while illustrated coaxial with longitudinal axis 215 of shaft 210 in FIG. 5, may be radially misaligned with, and/or laterally offset from longitudinal axis 215. Upper coil plate assembly 232 generally includes an upper hub 234 and a boot member 240. Upper hub 234 has a first or upper end 234*a*, a second or lower end 234*b*, and a centrally disposed bore or chamber 236 extending longitudinally into upper hub 234 from lower end 234*b*. The upper end 234*a* of upper hub 234 includes an annular groove 237 extending into an outer cylindrical surface thereof, and a centrally disposed bore 238 that extends longitudinally into upper hub 234 from upper end 234*a*, thereby intersecting chamber 236. Bore 238 is substantially greater in diameter than shaft 210, allowing ball 214 of shaft 210 the freedom to pivot within hub assembly 230 without contacting an inner surface of upper hub 234 defining bore 238. Boot member 240 includes an annular lip 242 received within the annular groove 237 of upper hub 234 for securing boot member 240 to upper hub 234. Boot member 240 also includes undulations 244 and a central aperture 246, where aperture 246 allows for the passage of shaft 210 and undulations 244 aid in providing flexibility to boot member 240 as shaft 210 pivots within hub assembly 230 at ball 214. In this embodiment, boot member 240 comprises an elastomeric material and is configured to prevent dirt, grime, or other contaminants from entering chamber 236 of upper hub 234.

Lower coil plate assembly 250 is disposed coaxially with longitudinal axis 235 of hub assembly 230 and generally includes a lower hub 252 threadably coupled to a cylindrical endcap 280. Lower hub 252 has a first or upper end 252*a*, a second or lower end 252*b*, and a centrally disposed bore or chamber 254 extending longitudinally into lower hub 252 from upper end 252*a* and terminating at a generally annular internal surface 256. The lower end 252*b* of lower hub 252 includes a bore 258 extending therein for receiving coil 255. An internal threaded coupler 258*t* is included on a longitudinally extending cylindrical inner surface of lower hub 252 for threadably coupling with a corresponding threaded coupler of endcap 280. Lower end 252*b* also includes a counterbore 260 extending longitudinally into lower hub 252 from lower end 252*b* and terminating at an annular internal surface 262. A centrally disposed cylindrical aperture 264 extends between chamber 254 and counterbore 260. In this arrangement, ground connector 228 of shaft 210 extends through aperture 264. The diameter of aperture 264 is significantly greater than the diameter of ground connector 228, thereby allowing ground connector 228 to pivot along with ball 214 of shaft 210 within hub assembly 230.

A shielded ground wire 266 has a first end coupled with ground connector 228 and a second end coupled to a fastener 268 that extends into inner surface 262 of counterbore 260, coupling ground wire 266 to lower hub 252. In this arrangement, ground wire 266 and fastener 268 act to ground shaft 210 with lower hub 252 of hub assembly 230. The lower end 252*b* of lower hub 252 further includes a cable passage 270 that extends between chamber 254 and bore 258, providing for the passage of cable 222 from chamber 254 to coil 255 to electrically connect cable 222 with coil 255. Cable passage 270 includes an annular seal 272 disposed therein to prevent dust, grime, or other contaminants from entering chamber 254 of lower hub 252, and in some embodiments, passage 270 may include shielding or insulation for insulating the wire disposed in cable 222 from lower hub 252.

Figure 6:
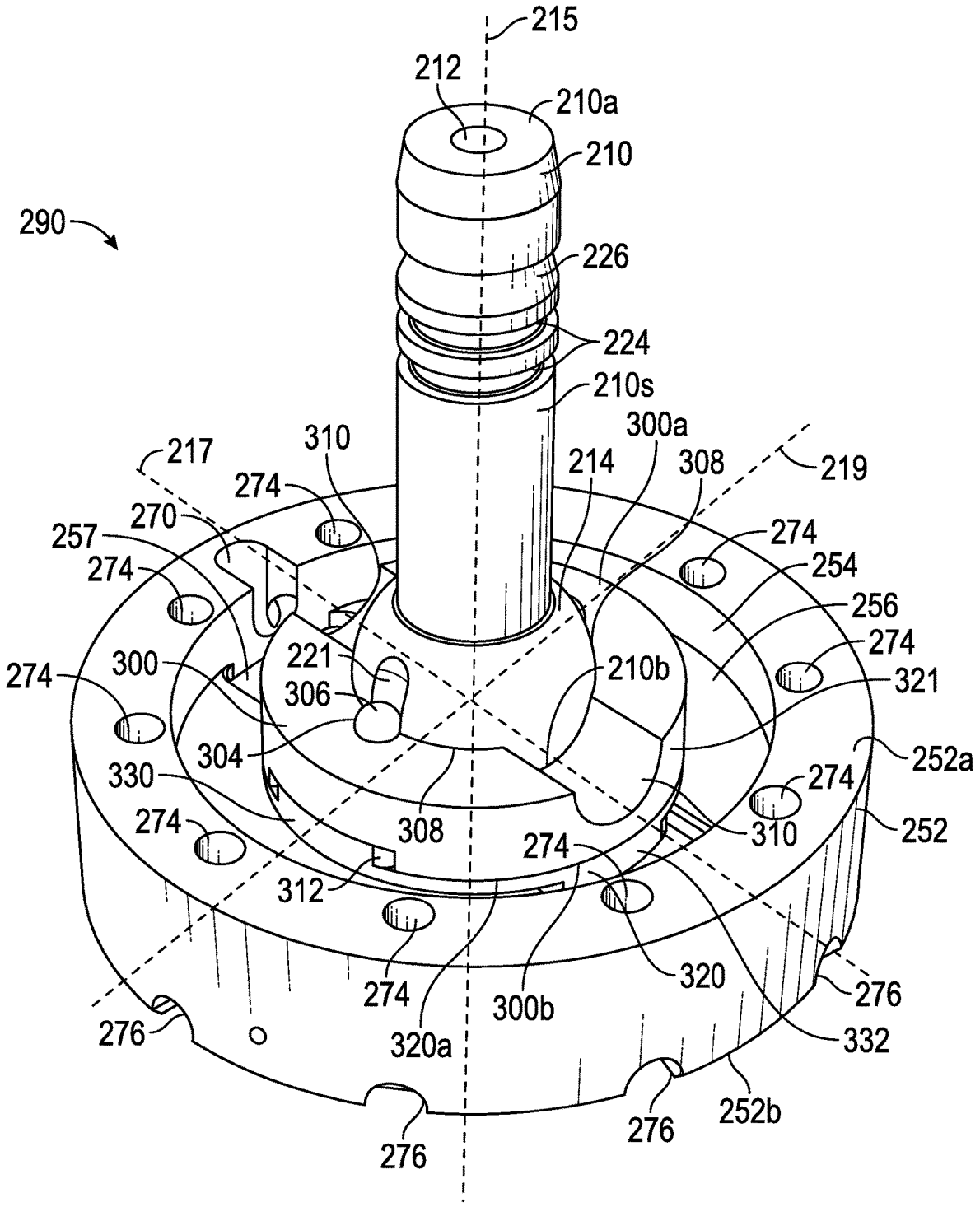
FIG. 6 is a perspective view of an embodiment of a ball joint assembly of the communicative coupler shown in FIG. 3 disposed in an aligned position.

Referring briefly to FIG. 6, lower hub 252 couples with upper hub 234 via a plurality of circumferentially spaced, longitudinally extending fasteners (not shown) that extend longitudinally through, and threadably couple with, lower hub 252 and upper hub 234. Particularly, lower hub 252 includes a plurality of circumferentially spaced apertures 274 extending longitudinally therethrough for receiving the threaded fasteners, where said fasteners extend through corresponding circumferentially spaced apertures (not shown) in upper hub 234. Lower hub 252 also includes a plurality of circumferentially spaced notches 276 disposed at lower end 252*b* for providing access to the threaded fasteners that couple lower hub 252 with upper hub 234.

Referring again to FIG. 5, endcap 280 of lower coil plate assembly 250 threadably couples with lower hub 252 and is generally configured to protect ground wire 266, fastener 268, and other electrical components disposed within hub assembly 230 from the surrounding environment (e.g., dust, grime, and other contaminants). Specifically, endcap 280 includes a first or upper end 280*a*, a second or lower end 280*b*, and a bore 282 extending longitudinally into endcap 280 from upper end 280*a*. Endcap 280 also includes a flange 284 extending radially outwards from an outer surface of endcap 280 and disposed longitudinally between upper end 280*a* and lower end 280*b*, where coil 255 is disposed directly adjacent an outer radial surface of flange 284. The outer surface of endcap 280 also includes a threaded coupler 280*t* for threadably coupling with threaded coupler 258*t* of lower hub 252. The upper end 280*a* of endcap 280 includes an annular groove 286 extending therein and including an annular seal 286*s* disposed therein for sealing against inner surface 262 of counterbore 260, thereby preventing dust, grime, or other contaminants from entering bore 282 of endcap 280.

In this embodiment, ball joint assembly 290 of coil assembly 202 is generally configured to allow shaft 210 to both angularly pivot within hub assembly 230 in any angular direction relative longitudinal axis 235, and also to move laterally within hub assembly 230, thereby forming a "floating" ball joint assembly. Particularly, both chamber 236 of upper hub 234 and chamber 254 of lower hub 252 are significantly greater in diameter than upper ball joint receptacle 292, upper positioning member 300, and lower positioning member 320, allowing components 292, 300, and 320 to be displaced or move laterally (respective longitudinal axis 235) within hub assembly 230 in multiple lateral directions respective longitudinal axis 235. Upper ball joint receptacle 292 is generally cylindrical and has a first or upper end 292*a*, a second or lower end 292*b*, a centrally disposed hemispherical chamber 294 extending into upper ball joint receptacle 292 from lower end 292*b*. Upper ball joint receptacle 292 further includes a centrally disposed generally cylindrical bore 296 extending into upper ball joint receptacle 292 from upper end 292*a* and intersecting hemispherical chamber 294. Bore 296 allows for the passage of shaft 210 therethrough while hemispherical bore 294 physically engages and supports the outer surface 210*s* of the ball 214 of shaft 210. Upper ball joint receptacle 292 is not coupled to or otherwise attached to upper hub 234, and thus, upper ball joint receptacle 292 is free to move or "float" laterally within chamber 236 of upper hub 234 along with ball 214 of shaft 210, upper positioning member 300, and lower positioning member 320.

Referring to FIGS. 6-10, shaft 210, upper positioning member 300, and lower positioning member 320 of ball joint assembly 290 are shown in detail. As shown particularly in FIG. 6, longitudinal axis 215 of shaft 210 orthogonally intersects an x-axis 217 that extends in a first lateral direction and also orthogonally intersects a z-axis 219 that extends in a second lateral direction, where x-axis 217 intersects z-axis 219 orthogonally. Upper positioning member 300 is generally cylindrical and has a first or upper end 300*a*, a second or lower end 300*b*, and a centrally disposed, generally cylindrical bore 302 extending longitudinally between upper end 300*a* and lower end 300*b*. Upper end 300*a* of upper positioning member 300 includes a pair of generally hemispherical (e.g., quarter-spherical) receptacles 304 extending therein that are spaced circumferentially 180 degree apart, where each receptacle 304 receives a locking ball 306. Upper end 300*a* also includes a pair of curved or hemispherical surfaces or receptacles 308 extending between upper end 300*a* and bore 302 for receiving the hemispherical outer surface 210*s* of shaft 210 at ball 214, where hemispherical receptacles 308 are circumferentially spaced approximately 180 degrees apart along an axis disposed parallel with z-axis 219 as shown in FIG. 6. Upper end 300*a* of upper positioning member 300 further includes a pair of curved grooves 310 extending therein that are circumferentially spaced approximately 180 degrees part, where curved grooves 310 are disposed along an axis parallel with x-axis 217.

Ball 214 of shaft 210 includes a pair of arcuate grooves 221 extending into outer surface 210*s* of shaft 210, where each arcuate groove 221 extends longitudinally from lower end 210*b*. Arcuate grooves 221 are circumferentially spaced approximately 180 degrees apart. As shown particularly in FIG. 6, each locking ball 306 is received within both an arcuate groove 221 of shaft 210 and a corresponding receptacle 304, thereby restricting relative rotation between shaft 210 and upper positioning member 300 about longitudinal axis 215. Preventing relative rotation between shaft 210 and upper positioning member 300 ensures that cable 222 is not damaged when torque is applied to either shaft 210 or hub assembly 230. However, engagement between arcuate grooves 221, locking balls 306, and receptacles 304 allows shaft 210 to pivot within hemispherical receptacles 308 of upper positioning member 300. Particularly, shaft 210 may angularly pivot within hemispherical receptacles 308 in the direction of both x-axis 217 and z-axis 219, or in other words, shaft 210 may angularly pivot to reduce an angle between longitudinal axis 215 and either x-axis 217 and z-axis 219. Further, curved grooves 310 allow for the passage of cable 222 (shown in FIG. 5) to coil 255 as shaft 210 pivots within hemispherical receptacles 308. As shown particularly in FIG. 9, the lower end 300*b* of upper positioning member 300 includes a generally rectangular groove 312 extending longitudinally therein, where rectangular groove 312 is disposed along an axis parallel with z-axis 219 as shown in FIG. 6.

Lower positioning member 320 of ball joint assembly 290 is generally cylindrical and has a first or upper end 320*a*, a second or lower end 320*b*, and a centrally disposed bore 322 extending between upper end 320*a* and lower end 320*b*, where bore 322 is defined by a cylindrical inner surface 324. Bore 322 of lower positioning member 320 includes a pair of first curved grooves 326 extending radially into inner surface 324, where first curved grooves 326 are circumferentially spaced approximately 180 degrees apart. Bore 322 of lower positioning member 320 also includes a pair of second curved grooves 328 extending radially into inner surface 324, where second curved grooves 328 are circumferentially spaced approximately 180 degrees apart. In this arrangement, first curved grooves 326 are spaced approximately 90 degrees from second curved grooves 328. First curved grooves 326 and second curved grooves 328 are configured to provide space for ground connector 228 to pivot along with shaft 210 as shaft 210 pivots within hemispherical receptacles 308.

Lower positioning member 320 also includes a generally rectangular upper ledge or tongue 330 extending longitudinally from upper end 320*a* and laterally along an axis parallel with z-axis 219 shown in FIG. 6. Upper tongue 330 of lower positioning member 320 is received within and physically engages rectangular groove 312 of upper positioning member 300 to: restrict relative rotation between upper positioning member 300 and lower positioning member 320 about longitudinal axis 215, restrict relative lateral movement between upper positioning member 300 and lower positioning member 320 along x-axis 217, and to permit relative lateral movement between upper positioning member 300 and lower positioning member 320 along z-axis 219. Lower positioning member 320 further includes a generally rectangular ledge or lower tongue 332 extending longitudinally from lower end 320*b* and laterally along an axis parallel with x-axis 217 shown in FIG. 6. In this arrangement, upper tongue 330 and lower tongue 332 are disposed along axes that intersect substantially orthogonally.

Figure 7:
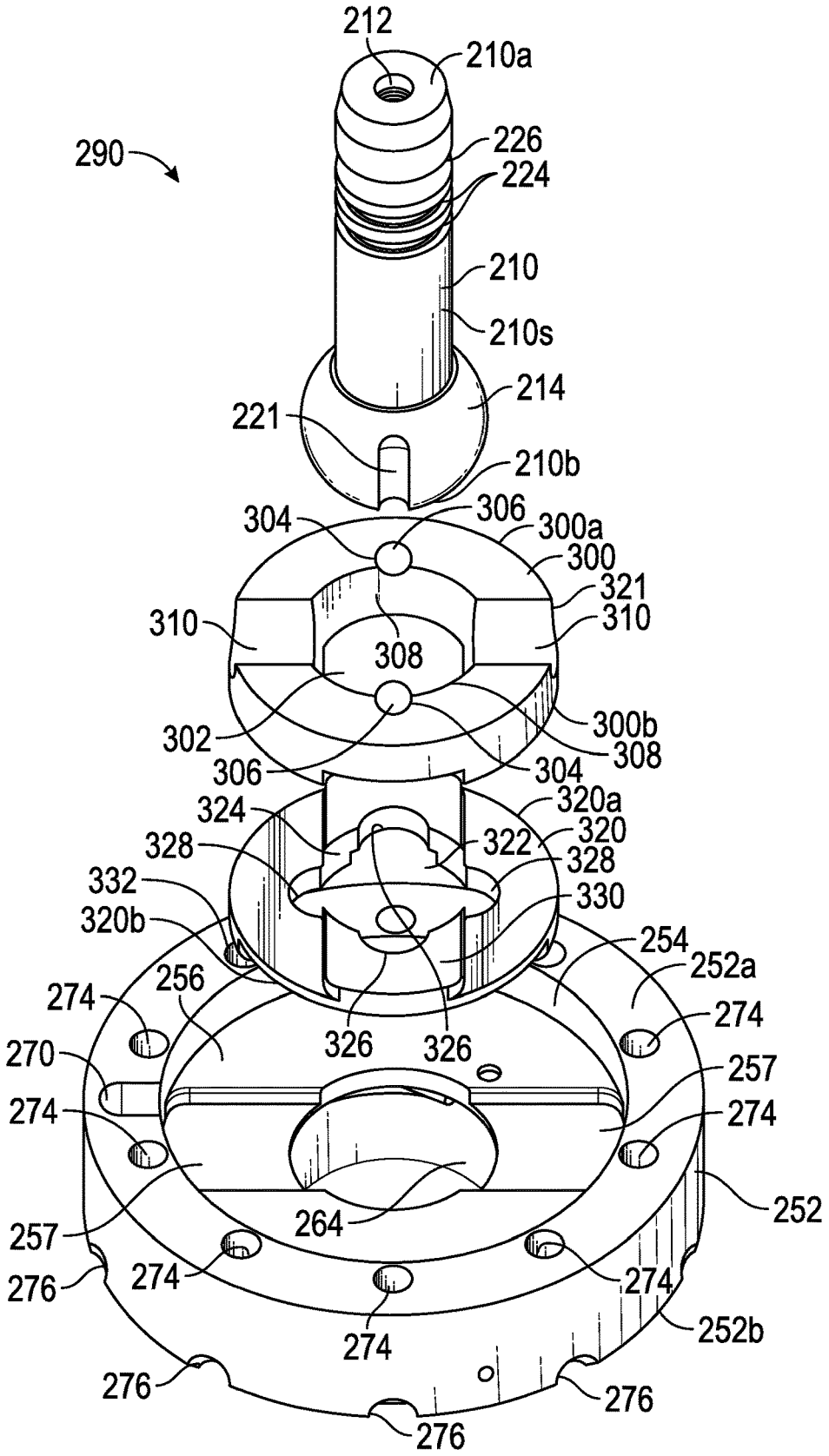
FIG. 7 is an exploded perspective view of the ball joint assembly shown in FIG. 6.
Figure 8:
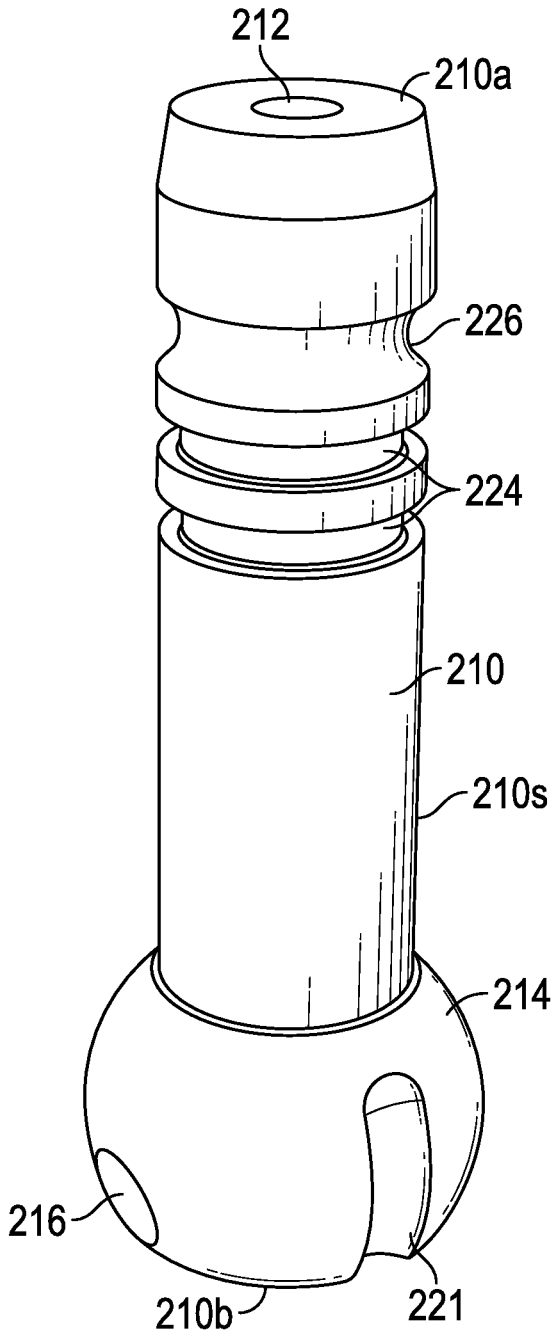
FIG. 8 is a perspective view of an embodiment of a shaft member of the ball joint assembly shown in FIG. 6.
Figure 9:
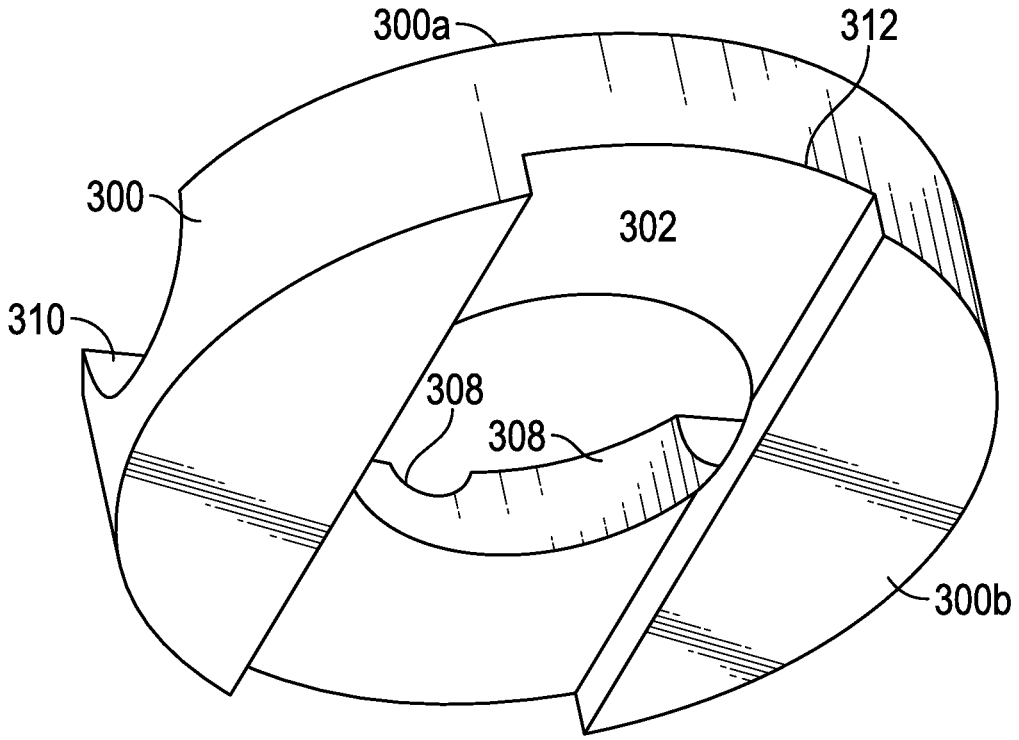
FIG. 9 is a lower perspective view of an embodiment of an upper positioning member of the ball joint assembly shown in FIG. 6.
Figure 10:
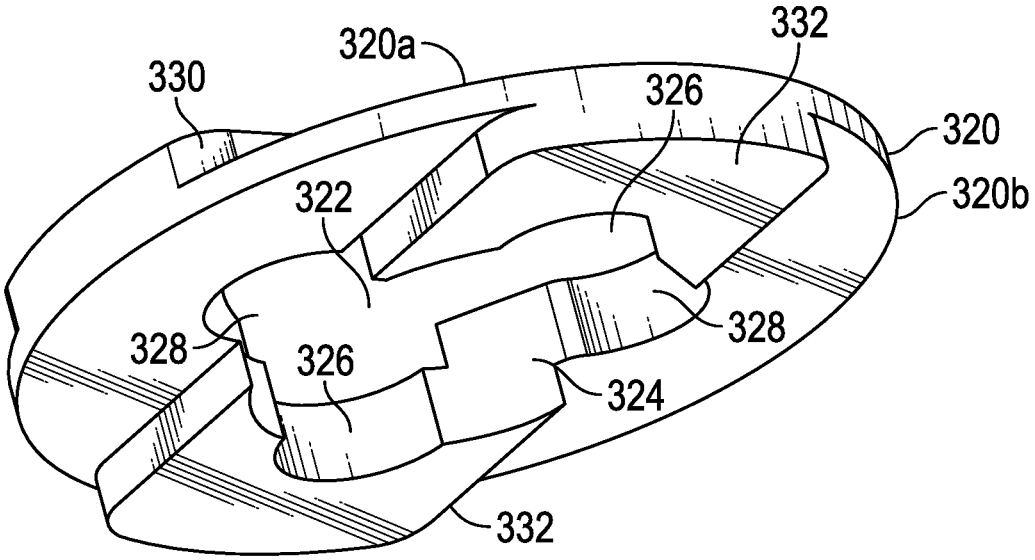
FIG. 10 is a lower perspective view of an embodiment of a lower positioning member of the ball joint assembly shown in FIG. 6.

As shown particularly in FIG. 7, internal surface 256 of the chamber 254 of lower hub 252 includes a generally rectangular groove 257 extending longitudinally therein and laterally along an axis parallel with x-axis 217. Lower tongue 332 of lower positioning member 320 is configured to be received within and physically engage rectangular groove 257 of lower hub 252 to: restrict relative rotation between lower hub 252 and lower positioning member 320 about longitudinal axis 215, restrict relative lateral movement between lower hub 252 and lower positioning member 320 along z-axis 219, and to permit relative lateral movement between lower hub 252 and lower positioning member 320 along x-axis 217.

The ability to laterally displace shaft 210 respective lower hub 252 and hub assembly 230 may be advantageous where a lateral offset or misalignment occurs between shaft 210 and the coil 48 of the uppermost tubular 42. For instance, during a tripping operation, the longitudinal axis 45 of uppermost tubular 42 may become offset from longitudinal axis 215 of shaft 210. In such a scenario, in order to maintain an electromagnetic connection between coils 255 and 48, the longitudinal axis 235 of hub assembly 230 must remain in substantial angular and lateral alignment with longitudinal axis 45 of uppermost tubular 42. Thus, in order to maintain angular and lateral alignment between longitudinal axes 235 and 45 in the scenario where longitudinal axes 215 and 45 become angularly and/or laterally offset, the longitudinal axis 215 of shaft 210 must be allowed to become angularly and/or laterally offset from longitudinal axis 235 of hub assembly 230 while maintaining an electrical connection between coil 255 and the electrical connector 220 coupled to shaft 210.

Figure 11:
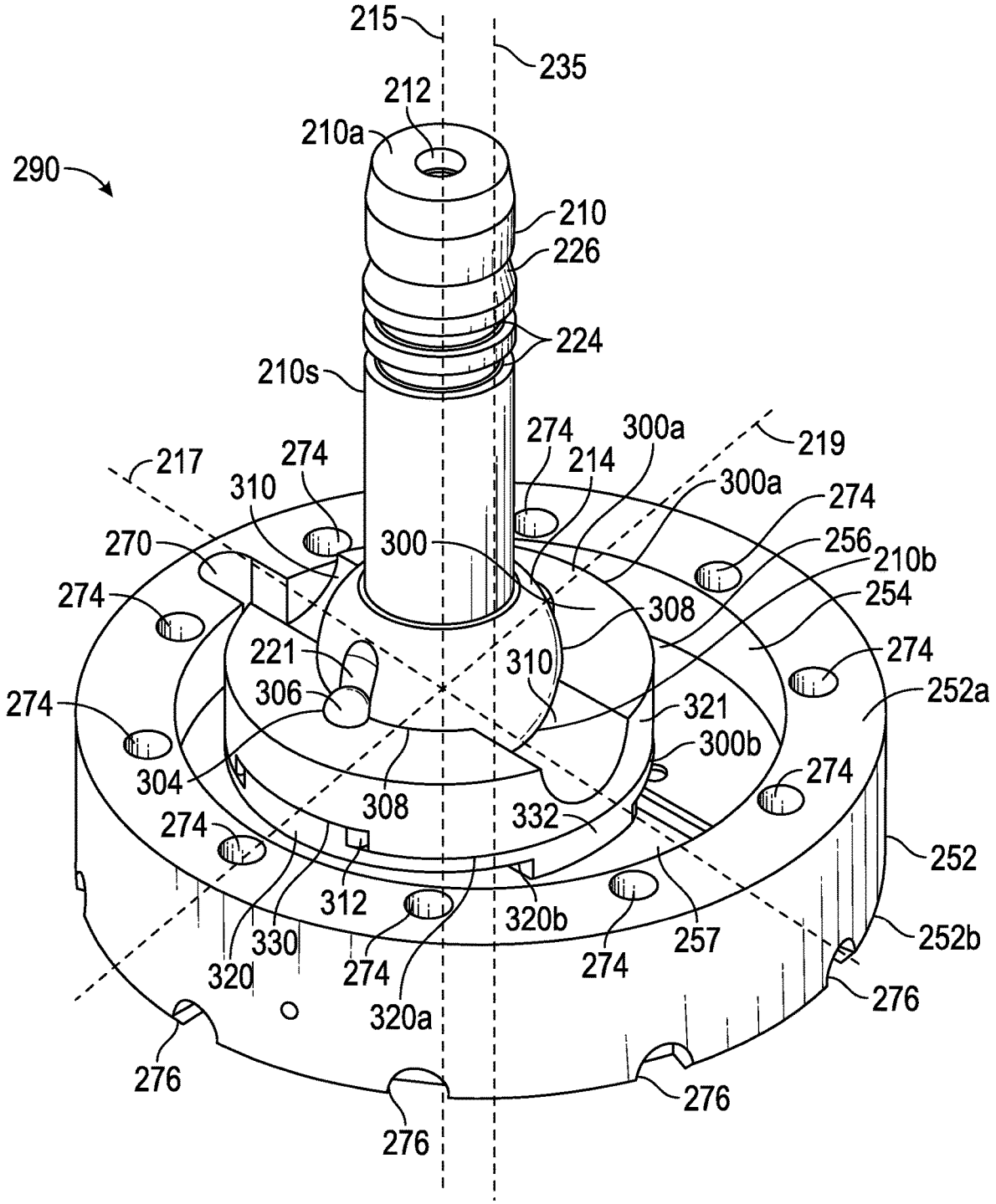
FIG. 11 is a perspective view of the ball joint assembly shown in FIG. 6 disposed in a first laterally offset position.
Figure 12:
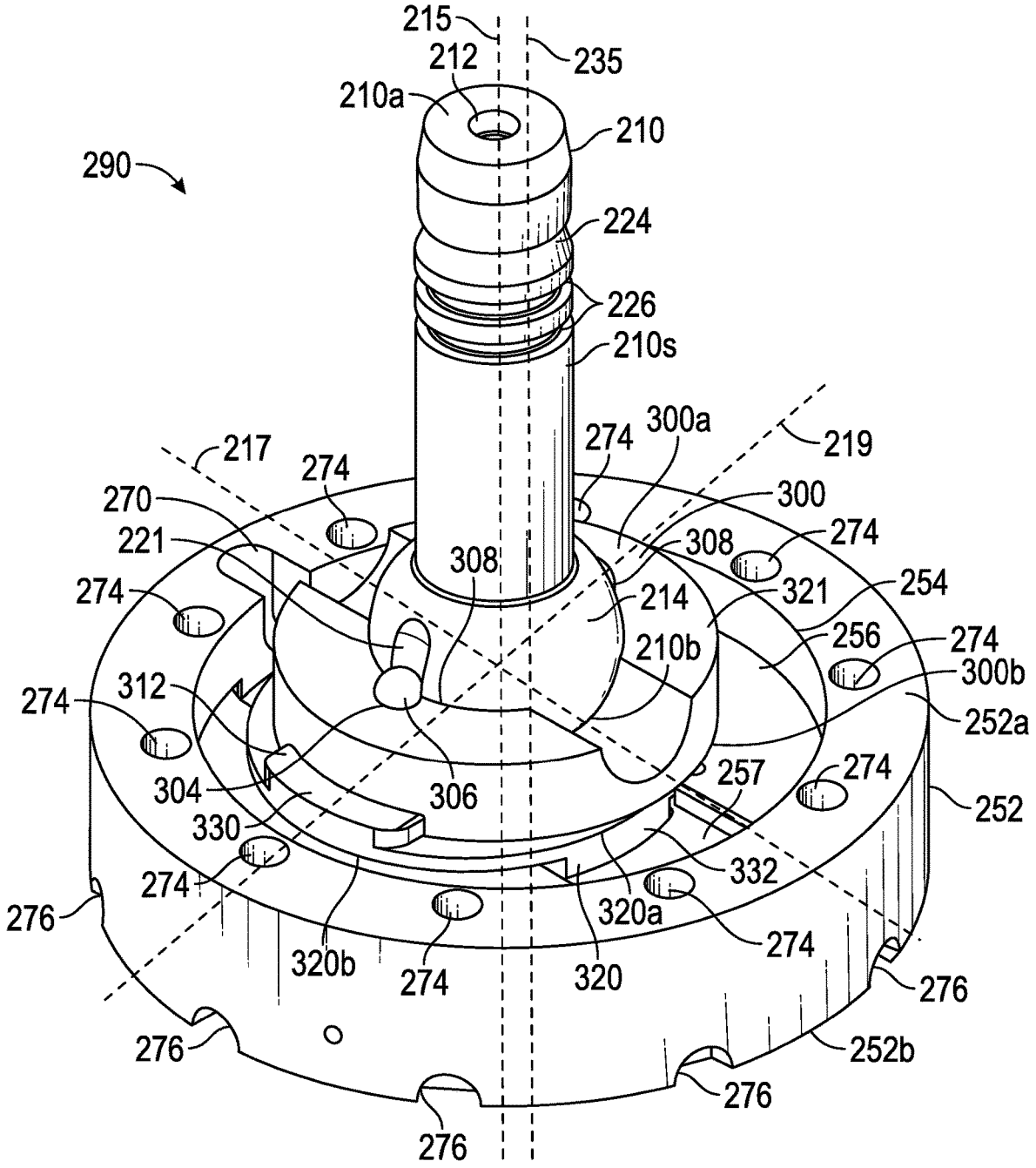
FIG. 12 is a perspective view of the ball joint assembly shown in FIG. 6 disposed in a second laterally offset position.

As shown particularly in FIGS. 6, 11, and 12, engagement between upper positioning member 300, lower positioning member 320, and lower hub 252 allows for shaft 215 to be displaced laterally along x-axis 217 and z-axis 219. Further, the curved, hemispherical engagement between ball 214 of shaft 210 and hemispherical receptacles 308 of upper positioning member 300 allows longitudinal axis 215 to be angularly offset from longitudinal axis 235 of hub assembly in the direction of x-axis 217 and/or the direction of z-axis 219. In other words, shaft 210 is free to pivot within hemispherical receptacles 308 such that the angle between longitudinal axis 215 and x-axis 217 is altered, and/or the angle between longitudinal axis 215 and z-axis 219 is altered.

As an example of the lateral offset provided by ball joint assembly 290, FIG. 11 illustrates a lateral offset of longitudinal axis 215 of shaft 210 from longitudinal axis 235 of hub assembly 230 along x-axis 217. In this arrangement, lower tongue 332 of lower positioning member 320 slidingly engages and is displaced along x-axis 217 through rectangular groove 257 in lower hub 252. Due to the interlocking arrangement between upper tongue 330 of lower positioning member 320 and the rectangular groove 312 of upper positioning member 300, which restricts relative lateral movement between upper positioning member 300 and lower positioning member 320 along x-axis 217, upper positioning member 300 and shaft 210 are displaced laterally along x-axis 217 along with lower positioning member 320.

As a second example of the lateral offset provided by ball joint assembly 290, FIG. 12 illustrates longitudinal axis 215 of shaft 210 laterally offset from longitudinal axis 235 of hub assembly 230 along both x-axis 217 and z-axis 219. Similar to FIG. 11, FIG. 12 illustrates shaft 210, upper positioning member 300 and lower positioning member 310 laterally offset along x-axis 217 as lower tongue 332 of lower positioning member 320 is displaced through rectangular groove 257 of lower hub 252. Further, in FIG. 12 shaft 210 and upper positioning member 300 are displaced laterally along z-axis 219 respective lower positioning member 320 and lower hub 252. Particularly, upper positioning member 300 is displaced along z-axis 219 over lower positioning member 320 as upper tongue 330 of lower positioning member 320 slidingly engages rectangular groove 312 of upper positioning member 300. Thus, in this manner ball joint assembly 290 provides for both angular and lateral offset along x-axis 217 and/or z-axis 219 of longitudinal axis 215 of shaft 210 and longitudinal axis 235 of hub assembly 230.

Figure 13:
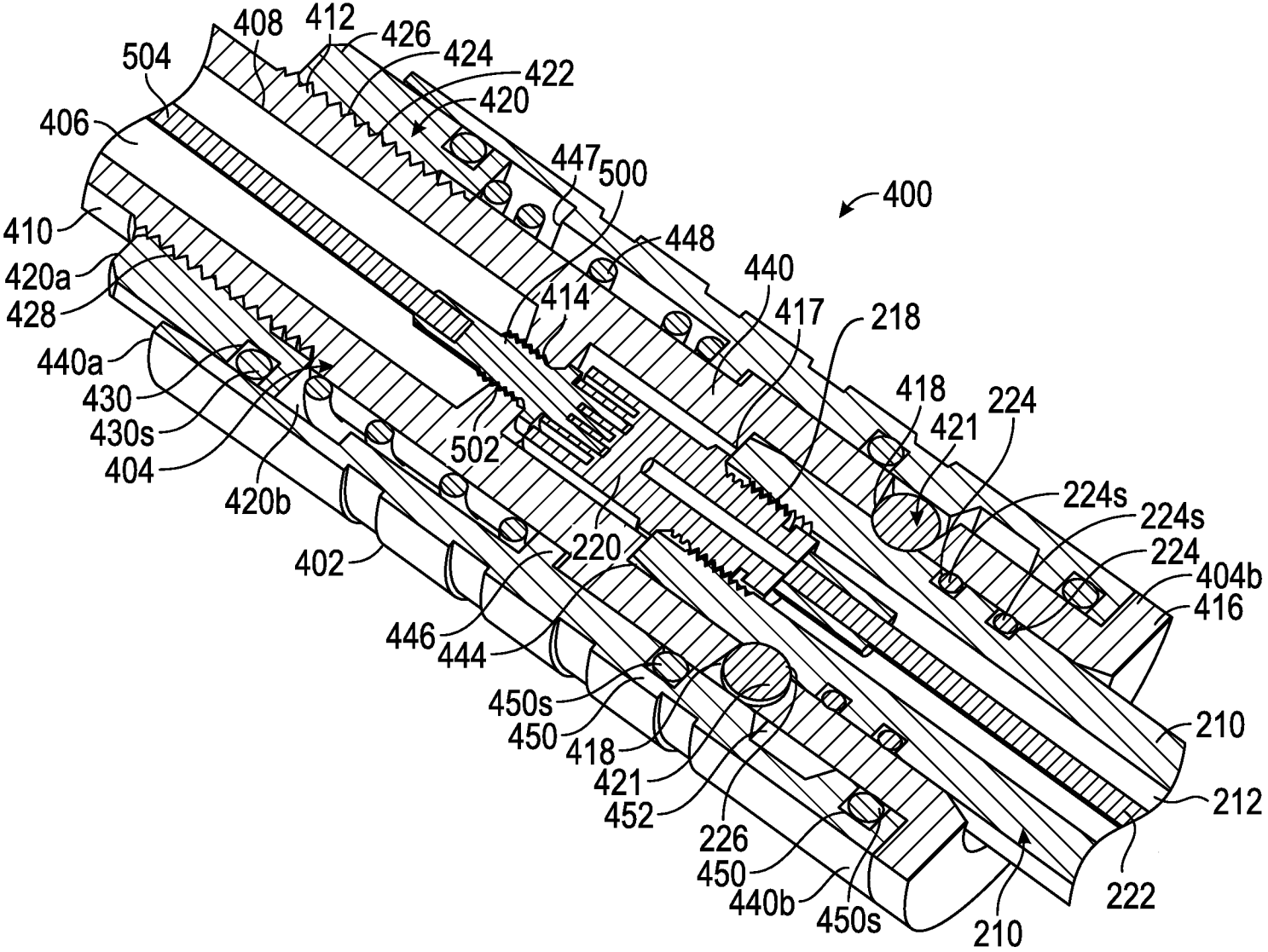
FIG. 13 is a cross-sectional view of an embodiment of a connector assembly of the communicative coupler shown in FIG. 3 disposed in a connected position, the section taken along lines 4-4 of FIG. 3.
Figure 14:
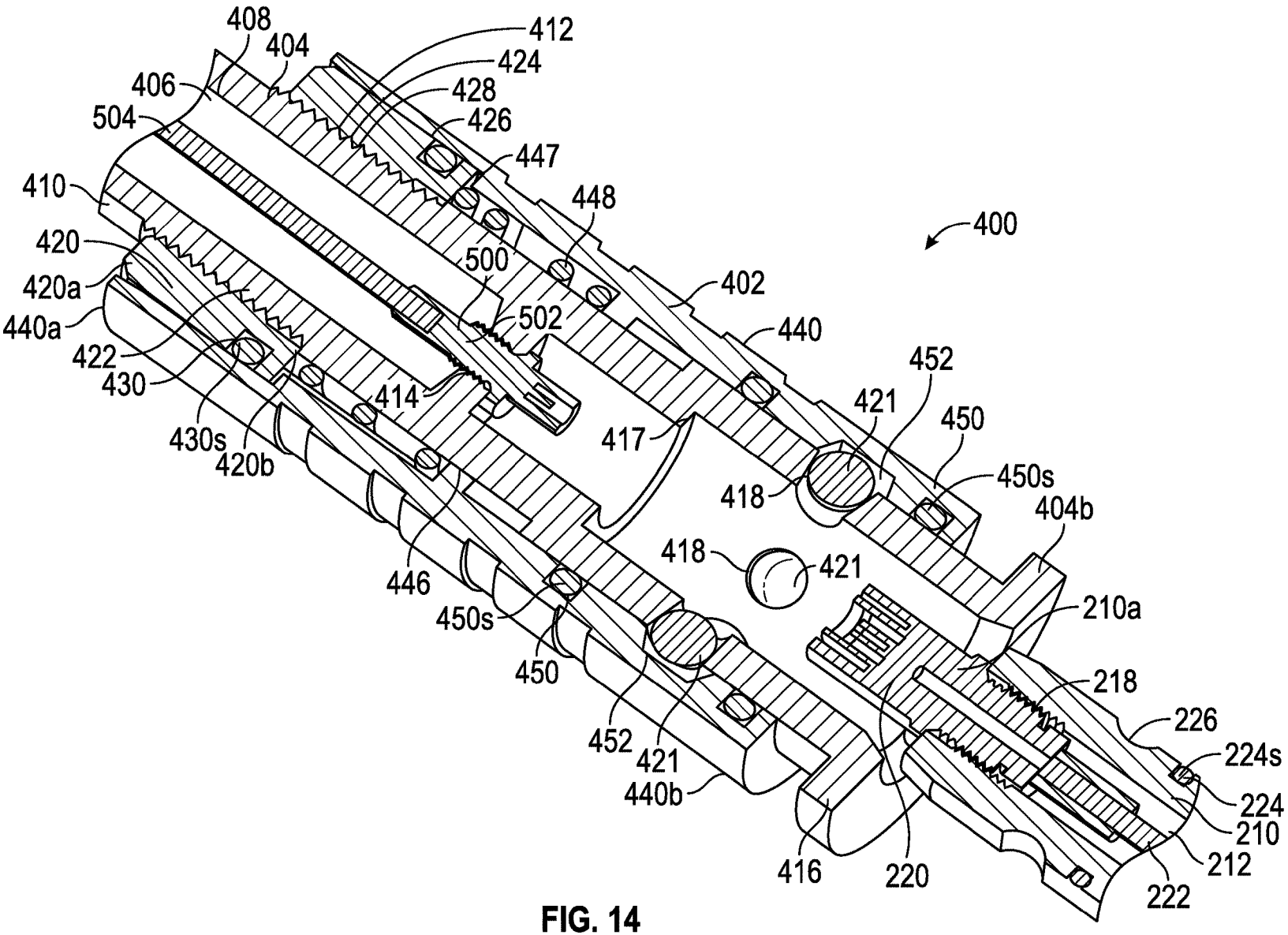
FIG. 14 is a cross-sectional view of the connector assembly shown in FIG. 13 disposed in a disconnected position, the section taken along lines 4-4 of FIG. 3.

Referring to FIGS. 4, 13, and 14, as described above, connector assembly 400 is configured to provide a releasable connection between coil assembly 202 and the support arm 112 of support system 40. More particularly, connector assembly 400 is configured to provide a releasable mechanical connection (via mechanical connector 402) between coil assembly 202 and the support arm 112. Connector assembly 400 further provides a releasable electrical connection (via electrical connector 500) between the surface interface system 26 and coil 255 of coil assembly 202, where the shaft 210 of coil assembly 202 does not need to be specifically or particularly angularly oriented relative connector assembly 400 to effect and maintain a proper mechanical and electrical connection between connector assembly 400 and coil assembly 202.

In the embodiment shown in FIGS. 4, 13, and 14, mechanical connector 402 of connector assembly 400 generally includes an elongate member 404, a collar 420, and a sliding sleeve 440. Elongate member 404 is generally tubular and has a first or upper end 404*a* (shown in FIG. 4), a second or lower end 404*b*, and a passage or throughbore 406 extending between upper end 404*a* and lower end 404*b* and defined by an inner surface 408. An outer cylindrical surface 410 of elongate member 404 includes external threads 412 disposed thereon. External threads 412 at upper end 404*a* of elongate member 404 threadably couple connector assembly 400 to support arm 112 of support system 40. Elongate member 404 includes an internal threaded coupler 414 that extends radially inwards from inner surface 408 for threadably coupling with an external threaded coupler 502 of electrical connector 500, thereby threadably coupling electrical connector 500 to elongate member 404 and mechanical connector 402. The outer surface 410 of elongate member 404 includes a radially outwards extending flange 416 at lower end 404*b* that is configured to physically engage sliding sleeve 440.

Elongate member 404 also includes a plurality of circumferentially spaced circular apertures 418 disposed longitudinally between internal threaded connector 414 and flange 416 for receiving a plurality of generally spherical locking balls 421. As will be discussed further herein, locking balls 421 are arranged to mechanically lock upper end 210*a* to mechanical connector 402 to form a mechanical connection between coil assembly 202 and connector assembly 400. Elongate member 404 further includes an internal annular shoulder 417 for physically engaging or contacting the upper end 210*a* of shaft 210 as shown in FIG. 13. Collar 420 is generally cylindrical and has a first or upper end 420*a*, a second or lower end 420*b*, and an internal throughbore 422 extending between upper end 420*a* and lower end 420*b* and defined by an inner surface 424 and, and an outer cylindrical surface 426. Inner surface 424 includes internal threads 428 for threadably connecting with external threads 412 of elongate member 404. Outer surface 426 of collar 420 includes an annular groove 430 extending therein that receives an annular seal 430*s* for sealing against an inner surface of sliding sleeve 440. In this arrangement, collar 420 is generally configured to delimit the longitudinal displacement of sliding sleeve 440.

Sliding sleeve 440 is configured to actuate mechanical connector 402 between a connected position (shown in FIG. 13) and a disconnected position (shown in FIG. 14). In the embodiment shown in FIGS. 4, 13, and 14, sliding sleeve 440 is generally tubular and has a first or upper end 440*a*, a second or lower end 440*b*, and a passage or internal throughbore 442 defined by an inner surface 444 and extending between upper end 440*a* and lower end 440*b*. Sliding sleeve 440 includes a first inner shoulder or flange 446 that extends radially inwards from inner surface 444. A biasing member 448 extends longitudinally between lower end 420*b* of collar 420 and first inner flange 446 of sliding sleeve 440. In the embodiment shown in FIGS. 4, 13, and 14, biasing member 448 comprises a coil spring; however, in other embodiments biasing member 448 may comprise other types of biasing members known in the art. Biasing member 448 is generally configured to bias sliding sleeve 440 such that lower end 440*b* of sliding sleeve 440 physically engages flange 416 of elongate member 404. Sliding sleeve 440 also includes a second inner shoulder or flange 447 that extends radially inwards from inner surface 444 and is disposed longitudinally between upper end 440*a* and first inner flange 446.

Sliding sleeve 440 also includes a pair of longitudinally spaced annular grooves 450 that extend radially into inner surface 440 and where the lowermost annular groove 450 is disposed at lower end 440*b*. Each annular groove 450 receives an annular seal 450*s* for sealing against the outer surface 410 of elongate member 404. Sliding sleeve 440 further includes an annular groove or receptacle 452 that extends into radially into inner surface 440 and is disposed longitudinally between the pair of annular grooves 450. Annular receptacle 452 is configured to receive locking balls 421 when mechanical connector 402 is transitioned to the disconnected position shown in FIG. 14.

In the embodiment shown in FIGS. 4, 13, and 14, electrical connector 500 comprises a male electrical connector while electrical connector 220 of shaft 210 comprises a female connector configured to releasably couple with electrical connector 500 to form an electrical connection therebetween. Electrical connector 500 is coupled with a shielded cable 504 that passes through an aperture 419 (shown in FIG. 4) that extends radially through elongate member 404, allowing cable 504 to pass an electrical signal, power, or data, to or from surface interface system 26. A terminal end of cable 504 distal electrical connector 500 includes an electrical connector 508 (shown in FIG. 4) for connecting with a connector of surface interface system 26. Mechanical connector 402 of connector assembly 400 is configured to transition between the connected position shown in FIG. 13 and the disconnected position shown in FIG. 14 in response to sliding the sliding sleeve 440 in the longitudinal direction of collar 420.

Specifically, in the connected position shown in FIG. 13, locking balls 421 are forced into physical engagement with annular groove 226 of shaft 210 by the inner surface 444 of sliding sleeve 440, thereby causing balls 421 to occupy both annular groove 226 and apertures 418 of elongate member 404. With locking balls 421 disposed in both annular groove 226 of shaft 210 and apertures 418 of elongate member 404, relative longitudinal movement between shaft 210 and elongate member 404 is restricted, thereby locking upper end 210*a* of shaft 210 into position within mechanical connector 402 and electrical connector 220 into engagement with electrical connector 500. Thus, locking balls 421 act to retain or prevent the inadvertent disconnection of the electrical connection formed between electrical connectors 500 and 220. Further, in the connected position shown in FIG. 13, annular seals 430*s* sealingly engage the outer surface of collar 420 and the inner surface of sleeve 440, seals 450*s* sealingly engage the inner surface of sleeve 440 and the outer surface 410 of elongate member 404, and seals 224*s* sealingly engage the inner surface 408 of elongate member 440 to prevent dust, grime, or other contaminants from contacting electrical connectors 220 and 500.

To disconnect electrical connector 220 of shaft 210 from electrical connector 500 of connector assembly 400, the sliding sleeve 440 is longitudinally displaced in the direction of the upper end 404*a* of elongate member 404 against the biasing force provided by biasing member 448 until second inner flange 447 of sliding sleeve 440 contacts lower end 420*b* of collar 420, as shown in FIG. 14. In this position, annular receptacle 452 of sliding sleeve 440 aligns with apertures 418 of elongate member 404. In response to a force applied to shaft 210 in the direction longitudinally opposite mechanical connector 402, annular groove 226 of shaft 210 forces locking balls 421 radially outwards into annular receptacle 440, unlocking shaft 210 from mechanical connector 402, and allowing electrical connector 220 of shaft 210 to disconnect from electrical connector 500 of connector assembly 400. In this manner, mechanical connector 402 ensures that electrical connector 220 of shaft 210 remains connected to electrical connector 500 of connector assembly 400 (regardless of vibrations, etc., applied to connector assembly 400) until sliding sleeve 440 is displaced into the longitudinal position shown in FIG. 14, irrespective of the relative angular orientation between shaft 210 and mechanical connector 402. In particular, because mechanical connector 402 provides for a releasable mechanical connection that only requires the upper end 210*a* of shaft 210 to be axially inserted into mechanical connector 402 while sliding sleeve 440 is displaced into the longitudinal position shown in FIG. 14, there is no need to angularly orient shaft 210 relative to mechanical connector 402.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims.

What is claimed is:

1. A communicative coupler for a tubular member, comprising:

a hub having a longitudinal hub axis and a chamber disposed therein;

a coil disposed in the hub for electromagnetically communicating with a coil of the tubular member;

a shaft having a longitudinal shaft axis, a first end, and a second end, wherein the second end of the shaft is pivotally coupled to the hub; and a positioning assembly disposed in the chamber of the hub that engages the second end of the shaft, and wherein the positioning assembly is configured to allow the longitudinal shaft axis to become laterally offset from the longitudinal hub axis.

2. The communicative coupler of claim 1, further comprising:

a first electrical connector coupled to the first end of the shaft; and a connector assembly, comprising:

a mechanical connector configured to releasably couple with the first end of the shaft; and a second electrical connector configured to releasably connect with the first electrical connector;

wherein the connector assembly is configured to connect the first electrical connector with the second electrical connector irrespective of the angular orientation between the mechanical connector and the shaft.

3. The communicative coupler of claim 2, wherein the mechanical connector of the connector assembly comprises:

an elongate member having a radially translatable member disposed in a radial aperture of the elongate member; and a sleeve disposed about the elongate member that is slideable respective the elongate member and is configured to engage the radially translatable member.

4. The communicative coupler of claim 3, wherein the mechanical connector comprises:

a connected position wherein the sleeve is configured to forcibly dispose the radially translatable member in a groove that is disposed in the shaft to restrict relative movement between the elongate member and the sleeve; and a disconnected position wherein the radially translatable member is disposed in a groove of the sleeve and is configured to permit relative movement between the sleeve and the elongate member.

5. The communicative coupler of claim 1, wherein the positioning assembly comprises:

a first positioning member having a receptacle for receiving the second end of the shaft; and a second positioning member in engagement with the first positioning member, wherein the second positioning member comprises a first tongue that is received within a groove of an internal surface of the hub to provide for sliding engagement between the second positioning member and the hub along a first lateral direction respective the longitudinal hub axis.

6. The communicative coupler of claim 5, wherein the second positioning member comprises a second tongue that is received within a groove of the first positioning member for providing sliding engagement between the second positioning member and the first positioning member along a second lateral direction respective the longitudinal hub axis.

7. The communicative coupler of claim 6, wherein the first lateral direction is disposed substantially orthogonal the second lateral direction.

8. The communicative coupler of claim 1, further comprising a ball disposed in both a groove in the second end of the shaft and a receptacle of the positioning assembly to restrict relative rotation between the shaft and the positioning assembly about the longitudinal shaft axis.

9. A communicative coupler for a tubular member, comprising:

a hub having a chamber disposed therein and an internal surface;

a coil disposed in the hub for electromagnetically communicating with a coil of the tubular member;

a shaft having a first end and a second end, wherein the second end of the shaft is pivotally coupled to the hub; and a positioning assembly disposed in the chamber, wherein the positioning assembly is configured to slidingly engage the second end of the shaft and the internal surface of the hub.

10. The communicative coupler of claim 9, further comprising:

a first electrical connector coupled to the first end of the shaft; and a connector assembly, comprising:

a mechanical connector configured to releasably couple with the first end of the shaft; and a second electrical connector configured to releasably connect with the first electrical connector;

wherein the connector assembly is configured to connect the first electrical connector with the second electrical connector irrespective of the angular orientation between the mechanical connector and the shaft.

11. The communicative coupler of claim 10, wherein the connector mechanical connector of the connector assembly comprises:

an elongate member having a radially translatable member disposed in a radial aperture of the elongate member; and a sleeve disposed about the elongate member that is slideable respective the elongate member and is configured to engage the radially translatable member.

12. The communicative coupler of claim 11, wherein the mechanical connector comprises:

a connected position wherein the sleeve is configured to forcibly dispose the radially translatable member in a groove disposed in the shaft to restrict relative movement between the elongate member and the sleeve; and a disconnected position wherein the radially translatable member is disposed in a groove of the sleeve and is configured to permit relative movement between the sleeve and the elongate member.

13. The communicative coupler of claim 9, wherein the second end of the shaft comprises a ball received within the positioning assembly to form a ball joint between the shaft and the hub.

14. The communicative coupler of claim 9, wherein the positioning assembly comprises:

a first positioning member having a receptacle for receiving the second end of the shaft; and a second positioning member in engagement with the first positioning member, wherein the second positioning member comprises a first tongue that is received within a groove of an internal surface of the hub to provide for sliding engagement between the second positioning member and the hub along a first lateral direction respective the longitudinal hub axis.

15. The communicative coupler of claim 14, wherein the second positioning member comprises a second tongue that is received within a groove of the first positioning member for providing sliding engagement between the second positioning member and the first positioning member along a second lateral direction respective the longitudinal hub axis.

16. The communicative coupler of claim 15, wherein the first lateral direction is disposed substantially orthogonal to the second lateral direction.

17. A well system, comprising:

an elevator coupled to a drilling rig, wherein the elevator is configured to support a tubular member; and a communicative coupler coupled to the tubular member, comprising:

a hub having a longitudinal hub axis and a chamber disposed therein;

a coil disposed in the hub for electromagnetically communicating with a coil of the tubular member; and a shaft having a longitudinal shaft axis, a first end, and a second end, wherein the second end of the shaft comprises a ball and is pivotally coupled to the hub;

wherein the ball of the shaft is permitted to displace laterally respective the longitudinal hub axis of the hub within the chamber of the hub.

18. The well system of claim 17, wherein the communicative coupler further comprises:

a first electrical connector coupled to the first end of the shaft; and a connector assembly, comprising:

a mechanical connector configured to releasably couple with the first end of the shaft; and a second electrical connector configured to releasably connect with the first electrical connector;

wherein the connector assembly is configured to connect the first electrical connector with the second electrical connector irrespective of the angular orientation between the mechanical connector and the shaft.

19. The well system of claim 18, wherein the connector mechanical connector of the connector assembly comprises:

an elongate member having a radially translatable member disposed in a radial aperture of the elongate member; and a sleeve disposed about the elongate member that is slideable respective the elongate member and is configured to engage the radially translatable member.

20. The well system of claim 19, wherein the mechanical connector comprises:

a connected position wherein the sleeve is configured to forcibly dispose the radially translatable member in a groove disposed in the shaft to restrict relative movement between the elongate member and the sleeve; and a disconnected position wherein the radially translatable member is disposed in a groove of the sleeve and is configured to permit relative movement between the sleeve and the elongate member.

21. The well system of claim 20, wherein when the mechanical connector is in the connected position, an electrical connection is formed between the coil of the hub and a surface interface system.

22. The well system of claim 17, wherein the positioning assembly comprises:

a first positioning member having a receptacle for receiving the ball of the shaft; and a second positioning member engaging the first positioning member, wherein the second positioning member comprises a first tongue that is received within a groove of an internal surface of the hub to provide for sliding engagement between the second positioning member and the hub along a first lateral direction respective the longitudinal hub axis.

23. The well system of claim 22, wherein the second positioning member comprises a second tongue that is received within a groove of the first positioning member for providing sliding engagement between the second positioning member and the first positioning member along a second lateral direction respective the longitudinal hub axis.

24. The well system of claim 23, wherein the first lateral direction is disposed substantially orthogonal to the second lateral direction.

* * * * *